US011581117B2

(12) United States Patent
Yosui et al.

(10) Patent No.: US 11,581,117 B2
(45) Date of Patent: Feb. 14, 2023

(54) COIL-INCORPORATED MULTILAYER SUBSTRATE AND METHOD FOR MANUFACTURING THE SAME

(71) Applicant: Murata Manufacturing Co., Ltd., Nagaokakyo (JP)

(72) Inventors: Kuniaki Yosui, Nagaokakyo (JP); Shingo Ito, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 1149 days.

(21) Appl. No.: 15/695,037

(22) Filed: Sep. 5, 2017

(65) Prior Publication Data

US 2017/0365389 A1 Dec. 21, 2017

Related U.S. Application Data

(63) Continuation of application No. PCT/JP2016/063137, filed on Apr. 27, 2016.

(30) Foreign Application Priority Data

Jun. 11, 2015 (JP) ..... JP2015-118157

(51) Int. Cl.

| | |
|---|---|
| ***H01F 17/00*** | (2006.01) |
| ***H01F 41/04*** | (2006.01) |
| ***H01F 41/071*** | (2016.01) |
| ***H01F 27/28*** | (2006.01) |
| *H01F 27/29* | (2006.01) |

(52) U.S. Cl.

CPC ..... *H01F 17/0013* (2013.01); *H01F 27/2852* (2013.01); *H01F 41/042* (2013.01);

(Continued)

(58) Field of Classification Search

CPC ..... H01F 17/0013; H01F 2027/2809; H01F 17/0006; H01F 27/2804; H01F 5/003;

(Continued)

(56) References Cited

U.S. PATENT DOCUMENTS

| | | | | |
|---|---|---|---|---|
| 8,253,523 | B2 * | 8/2012 | Lee | H01F 17/0006 336/200 |
| 2008/0197963 | A1 * | 8/2008 | Muto | H01F 17/0013 336/200 |
| 2013/0154783 | A1 * | 6/2013 | Kato | H01F 19/04 336/200 |
| 2014/0319230 | A1 | 10/2014 | Murayama et al. | |

(Continued)

FOREIGN PATENT DOCUMENTS

| | | | |
|---|---|---|---|
| JP | 04351707 A | * | 12/1992 |
| JP | 08124745 A | * | 5/1996 |

(Continued)

OTHER PUBLICATIONS

Official Communication issued in International Patent Application No. PCT/JP2016/063137, dated Jul. 19, 2016.

*Primary Examiner* — Tszfung J Chan

(74) *Attorney, Agent, or Firm* — Keating & Bennett, LLP

(57) ABSTRACT

A coil-incorporated multilayer substrate includes base materials and a coil portion including conductor patterns that are wound a plurality of times on at least one of the base materials, and, in a predetermined direction along the surface of the base material of the coil portion, the width of outermost conductor patterns is larger than the widths of the conductor patterns between an innermost conductor pattern and an outermost conductor pattern, the width of the innermost conductor pattern is larger than the widths of the conductor patterns between the outermost conductor pattern and the innermost conductor pattern, and the width of the innermost conductor pattern is larger than the distance between the innermost conductor pattern and the conductor pattern adjacent to the innermost conductor pattern.

13 Claims, 14 Drawing Sheets

(52) U.S. Cl.
CPC ..... *H01F 41/071* (2016.01); *H01F 27/292* (2013.01); *H01F 2017/0073* (2013.01); *H01F 2017/0086* (2013.01); *H01F 2027/2809* (2013.01); *H01F 2027/2857* (2013.01)

(58) Field of Classification Search
CPC ..... H01F 27/2852; H01F 2017/0073; H01F 2027/2857; H01F 2017/0086
USPC ..... 336/200, 232; 257/531
See application file for complete search history.

(56) References Cited

U.S. PATENT DOCUMENTS

| | | | | |
|---|---|---|---|---|
| 2015/0187484 | A1* | 7/2015 | Jeong | H01F 27/292 336/200 |
| 2016/0027578 | A1 | 1/2016 | Nishino et al. | |
| 2016/0078998 | A1* | 3/2016 | Park | H01F 41/041 336/105 |
| 2016/0163445 | A1* | 6/2016 | Bertels | H02K 7/11 310/156.01 |

FOREIGN PATENT DOCUMENTS

| | | | | | |
|---|---|---|---|---|---|
| JP | 09045531 | A | * | 2/1997 | |
| JP | 09289128 | A | * | 11/1997 | |
| JP | 2004-140587 | A | | 5/2004 | |
| JP | 2008258600 | A | * | 10/2008 | H01L 23/522 |
| JP | 2012-195423 | A | | 10/2012 | |
| JP | 5655987 | B2 | | 1/2015 | |
| WO | 2015/079941 | A1 | | 6/2015 | |

* cited by examiner

COIL-INCORPORATED MULTILAYER SUBSTRATE AND METHOD FOR MANUFACTURING THE SAME

CROSS REFERENCE TO RELATED APPLICATIONS

This application claims the benefit of priority to Japanese Patent Application No. 2015-118157 filed on Jun. 11, 2015 and is a Continuation Application of PCT Application No. PCT/JP2016/063137 filed on Apr. 27, 2016. The entire contents of each application are hereby incorporated herein by reference.

BACKGROUND OF THE INVENTION

1. Field of the Invention

The present invention relates to a multilayer substrate that incorporates a coil, and, more particularly, relates to a coil-incorporated multilayer substrate including a base material made of thermoplastic resin and provided with a conductor pattern, and a method for manufacturing such a coil-incorporated multilayer substrate.

2. Description of the Related Art

Conventionally, a coil-incorporated multilayer substrate obtained by providing a coil in contact with a resin multilayer substrate has been disclosed and Japanese Unexamined Patent Application Publication No. 2012-195423, for example, discloses a method for manufacturing a coil-incorporated multilayer substrate by stacking a plurality of base materials made of thermoplastic resin and each including a conductor pattern, and thermally pressing the plurality of base materials.

Thus, since a multilayer substrate of which the base material is thermoplastic resin is able to be simultaneously molded by thermally pressing a plurality of base materials without using an adhesive layer, an electronic component and a circuit board are able to be configured with a reduced number of manufacturing steps and at low cost.

However, a problem is that a conductor pattern shift tends to occur with a flow of resin at the time of manufacturing a multilayer substrate of which the base material is thermoplastic resin. In other words, a base material made of thermoplastic resin is stacked in plural in order to configure a stacked body, and the resin of the base material flows in a step of thermally pressing the stacked body. As the resin flows, the conductor pattern formed in contact with the base material is likely to deform. In a case in which a coil is configured by a conductor pattern and the conductor pattern is deformed, the electrical characteristics of the coil will change. Since the manner in which a conductor pattern deforms is not constant, the obtained electrical characteristics of the coil vary.

SUMMARY OF THE INVENTION

Preferred embodiments of the present invention provide coil-incorporated multilayer substrates each including a base material made of thermoplastic resin and having reduced deformation of a conductor pattern, and methods for manufacturing such coil-incorporated multilayer substrates.

A coil-incorporated multilayer substrate according to a preferred embodiment of the present invention includes a conductor pattern made of metal foil; a base material made of thermoplastic resin and including the conductor pattern; and a coil including a plurality of conductor patterns, and the coil includes a coil axis in a stacking direction in which a plurality of base materials of the coil are stacked; the coil includes a coil portion defined by the plurality of conductor patterns that are shaped so as to be wound around the coil axis a plurality of times; at least one of the plurality of base materials includes the coil portion; on the base material on which the coil portion is provided, an outermost conductor pattern and an innermost conductor pattern are provided; and, in at least two perpendicular or substantially perpendicular axial directions along a surface of the base material, of the plurality of conductor patterns that define the coil portion:

a width of the outermost conductor pattern is larger than a width of the conductor patterns between the innermost conductor pattern and the outermost conductor pattern;

a width of the innermost conductor pattern is larger than the width of the conductor patterns between the outermost conductor pattern and the innermost conductor pattern; and the width of the innermost conductor pattern is larger than or equal to a distance between the innermost conductor pattern and the conductor pattern adjacent to the innermost conductor pattern.

With this configuration, since the outermost conductor pattern with a large width and the innermost conductor pattern with a large width, fix the resin that is about to flow, the deformation of the conductor pattern caused by the resin flow is significantly reduced or prevented.

In a preferred embodiment of the present invention, at least one of the outermost conductor pattern and the innermost conductor pattern may preferably be connected to an interlayer connection conductor. Accordingly, the resin is fixed by the interlayer connection conductor and the force of fixing the resin that is about to flow is further increased.

A coil-incorporated multilayer substrate according to a preferred embodiment of the present invention includes a conductor pattern made of metal foil; a base material made of thermoplastic resin and including the conductor pattern; and a coil including a plurality of conductor patterns, and the coil includes a coil axis in a stacking direction in which a plurality of base materials of the coil are stacked; the coil includes a coil portion defined by the plurality of conductor patterns that are shaped so as to be wound around the coil axis a plurality of times; at least one of the plurality of base materials includes the coil portion; on the base material on which the coil portion is provided, an outer dummy pattern defined by the conductor pattern on an outer side of the coil portion, and an inner dummy pattern defined by the conductor pattern on an inner side of the coil portion are provided; and, in at least two perpendicular or substantially perpendicular axial directions along a surface of the base material, of the plurality of conductor patterns that define the coil portion:

a width of the outer dummy pattern is larger than a width of the conductor patterns of the coil portion;

a width of the inner dummy pattern is larger than the width of the conductor patterns of the coil portion;

a distance between the outer dummy pattern and the conductor pattern of the coil portion adjacent to the outer dummy pattern is smaller than or equal to a distance between the conductor patterns of the coil portion; and a distance between the inner dummy pattern and the conductor pattern of the coil portion adjacent to the inner dummy pattern is smaller than or equal to the width of the inner dummy pattern.

With this configuration, since the outer dummy pattern and the inner dummy pattern fix the resin that is about to flow, the deformation of the conductor pattern caused by the resin flow is significantly reduced or prevented.

In a preferred embodiment of the present invention, at least one of the outer dummy pattern and the inner dummy pattern may preferably be connected to an interlayer connection conductor. Accordingly, the resin is fixed by the interlayer connection conductor and the force of fixing the resin that is about to flow is further increased.

A coil-incorporated multilayer substrate according to a preferred embodiment of the present invention includes a conductor pattern made of metal foil; a base material made of thermoplastic resin and including the conductor pattern; and a coil including a plurality of conductor patterns, and the coil includes a coil axis in a stacking direction in which a plurality of base materials of the coil are stacked; the coil includes a coil portion defined by the plurality of conductor patterns that are shaped so as to be wound around the coil axis a plurality of times; at least one of the plurality of base materials includes the coil portion; on the base material on which the coil portion is provided, an innermost conductor pattern and an outer dummy pattern defined by the conductor pattern on an outer side of the coil portion are provided; and, in at least two perpendicular or substantially perpendicular axial directions along a surface of the base material, of the plurality of conductor patterns that define the coil portion:

a width of the innermost conductor pattern is larger than a width of the conductor patterns of the coil portion other than the innermost conductor pattern;

the width of the innermost conductor pattern is larger than or equal to a distance between the innermost conductor pattern and the conductor pattern adjacent to the innermost conductor pattern;

a width of the outer dummy pattern is larger than the width of the conductor patterns of the coil portion between the innermost conductor pattern and the outer dummy pattern; and a distance between the outer dummy pattern and the conductor pattern of the coil portion adjacent to the outer dummy pattern is smaller than or equal to a distance between the conductor patterns of the coil portion, except a distance between the innermost conductor pattern and the conductor pattern adjacent to the innermost conductor pattern.

With this configuration, since the outer dummy pattern and the innermost conductor pattern with a large width fix the resin that is about to flow, the deformation of the conductor pattern caused by the resin flow is significantly reduced or prevented.

In a preferred embodiment of the present invention, at least one of the outer dummy pattern and the innermost conductor pattern may preferably be connected to an interlayer connection conductor. Accordingly, the resin is fixed by the interlayer connection conductor and the force of fixing the resin that is about to flow is further increased.

A coil-incorporated multilayer substrate according to a preferred embodiment of the present invention includes a conductor pattern made of metal foil; a base material made of thermoplastic resin and including the conductor pattern; and a coil including a plurality of conductor patterns, and the coil includes a coil axis in a stacking direction in which a plurality of base materials of the coil are stacked; the coil includes a coil portion defined by the plurality of conductor patterns that are shaped so as to be wound around the coil axis a plurality of times; at least one of the plurality of base materials includes the coil portion; on the base material on which the coil portion is provided, an outermost conductor pattern and an inner dummy pattern defined by the conductor pattern on an inner side of the coil portion are provided; and, in at least two perpendicular or substantially perpendicular axial directions along a surface of the base material, of the plurality of conductor patterns that define the coil portion:

a width of the outermost conductor pattern is larger than a width of the conductor patterns of the coil portion other than the outermost conductor pattern;

a width of the inner dummy pattern is larger than or equal to the width of the conductor patterns of the coil portion between the outermost conductor pattern and the inner dummy pattern; and a distance between the inner dummy pattern and the conductor pattern of the coil portion adjacent to the inner dummy pattern is smaller than or equal to the width of the inner dummy pattern.

With this configuration, since the outermost conductor pattern with a large width and the inner dummy pattern fix the resin that is about to flow, the deformation of the conductor pattern caused by the resin flow is significantly reduced or prevented.

In a preferred embodiment of the present invention, at least one of the outermost conductor pattern and the inner dummy pattern may preferably be connected to an interlayer connection conductor. Accordingly, the resin is fixed by the interlayer connection conductor and the force of fixing the resin that is about to flow is further increased.

In a preferred embodiment of the present invention, a distance between the outer dummy pattern and the conductor pattern of the coil portion adjacent to the outer dummy pattern may preferably be smaller than or equal to the width of the outer dummy pattern. Accordingly, the effect of significantly reducing or preventing the resin from flowing by the outer dummy pattern is increased, and the deformation of the conductor pattern caused by the resin flow is significantly reduced or prevented.

A coil-incorporated multilayer substrate according to a preferred embodiment of the present invention includes a conductor pattern made of metal foil; a base material made of thermoplastic resin and including the conductor pattern; and a coil including a plurality of conductor patterns, and the coil includes a coil axis in a stacking direction in which a plurality of base materials of the coil are stacked; the coil includes a coil portion defined by the plurality of conductor patterns that are shaped so as to be wound around the coil axis a plurality of times; at least one of the plurality of base materials includes the coil portion; on the base material on which the coil portion is provided, an outer dummy pattern defined by the conductor pattern on an outer side of the coil portion, and an inner dummy pattern defined by the conductor pattern on an inner side of the coil portion are provided; and, in at least two perpendicular or substantially perpendicular axial directions along a surface of the base material, of the plurality of conductor patterns that define the coil portion:

a width of the outer dummy pattern is larger than a width of the conductor patterns of the coil portion;

a width of the inner dummy pattern is larger than the width of the conductor patterns of the coil portion;

a distance between the outer dummy pattern and the conductor pattern of the coil portion adjacent to the outer dummy pattern is smaller than or equal to a distance between the conductor patterns of the coil portion; and a distance between the inner dummy pattern and the conductor pattern of the coil portion adjacent to the inner dummy pattern is smaller than or equal to a distance between the conductor patterns of the coil portion.

With this configuration, the effect of significantly reducing or preventing the resin from flowing by the inner dummy pattern is increased, and the deformation of the conductor pattern caused by the resin flow is significantly reduced or prevented.

A coil-incorporated multilayer substrate according to a preferred embodiment of the present invention includes a conductor pattern made of metal foil; a base material made of thermoplastic resin and including the conductor pattern; and a coil including a plurality of conductor patterns, and the coil includes a coil axis in a stacking direction in which a plurality of base materials of the coil are stacked; the coil includes a coil portion defined by the plurality of conductor patterns that are shaped so as to be wound around the coil axis a plurality of times; at least one of the plurality of base materials includes the coil portion; on the base material on which the coil portion is provided, an outermost conductor pattern and an inner dummy pattern defined by the conductor pattern on an inner side of the coil portion are provided; and, in at least two perpendicular or substantially perpendicular axial directions along a surface of the base material, of the plurality of conductor patterns that define the coil portion:

a width of the outermost conductor pattern is larger than a width of the conductor patterns of the coil portion other than the outermost conductor pattern;

a width of the inner dummy pattern is larger than the width of the conductor patterns of the coil portion between the outermost conductor pattern and the inner dummy pattern; and a distance between the inner dummy pattern and the conductor pattern of the coil portion adjacent to the inner dummy pattern is smaller than or equal to a distance between the conductor patterns of the coil portion.

With this configuration, the effect of significantly reducing or preventing the resin from flowing by the inner dummy pattern is increased, and the deformation of the conductor pattern caused by the resin flow is significantly reduced or prevented.

In a preferred embodiment of the present invention, a distance between the outermost conductor pattern and the conductor pattern of the coil portion adjacent to the outermost conductor pattern may preferably be smaller than or equal to the width of the outermost conductor pattern. Accordingly, the effect of significantly reducing or preventing the resin from flowing by the outermost conductor pattern is increased, and the deformation of the conductor pattern caused by the resin flow is significantly reduced or prevented.

In a preferred embodiment of the present invention, the conductor patterns may preferably include a conductor pattern provided on a surface of the base material; the conductor pattern may preferably include a contact surface in contact with the base material and a non-contact surface not in contact with the base material; and a surface roughness of the contact surface may preferably be larger than a surface roughness of the non-contact surface. Accordingly, the force of fixing the resin that is about to flow by a conductor pattern is increased, and the deformation of the conductor pattern caused by the resin flow is significantly reduced or prevented effectively. In addition, the surface roughness of the non-contact surface that is not contact with the base material is made relatively small, so that conductor loss (transmission loss) of the coil portion does not become large.

In a method for manufacturing a coil-incorporated multilayer substrate according to a preferred embodiment of the present invention, the coil-incorporated multilayer substrate includes a conductor pattern made of metal foil; a base material made of thermoplastic resin and including the conductor pattern; and a coil including a plurality of conductor patterns and configured by stacking a plurality of base materials, and the method includes a first step of preparing the plurality of base materials; a second step of forming the conductor pattern on a predetermined base material among the plurality of base materials; a third step of stacking the plurality of base materials to define a stacked body; and a fourth step of thermally pressing the stacked body and softening and bonding the base materials, and the coil includes a coil axis in a stacking direction in which the plurality of base materials are stacked; the coil includes a coil portion defined by the plurality of conductor patterns that are shaped so as to be wound around the coil axis a plurality of times; at least one of the plurality of base materials includes the coil portion formed thereon; on the base material on which the coil portion is formed, an outermost conductor pattern and an innermost conductor pattern are provided; and, in at least two perpendicular or substantially perpendicular axial directions along a surface of the base material, of the plurality of conductor patterns that define the coil portion:

a width of the outermost conductor pattern is larger than a width of the conductor patterns between the innermost conductor pattern and the outermost conductor pattern;

a width of the innermost conductor pattern is larger than the width of the conductor patterns between the outermost conductor pattern and the innermost conductor pattern; and the width of the innermost conductor pattern is larger than or equal to a distance between the innermost conductor pattern and the conductor pattern adjacent to the innermost conductor pattern.

In a method for manufacturing a coil-incorporated multilayer substrate according to a preferred embodiment of the present invention, the coil-incorporated multilayer substrate includes a conductor pattern made of metal foil; a base material made of thermoplastic resin and including the conductor pattern; and a coil including a plurality of conductor patterns and configured by stacking a plurality of base materials, and the method includes a first step of preparing the plurality of base materials; a second step of forming the conductor pattern on a predetermined base material among the plurality of base materials; a third step of stacking the plurality of base materials to define a stacked body; and a fourth step of thermally pressing the stacked body and softening and bonding the base materials, and the coil includes a coil axis in a stacking direction in which the plurality of base materials are stacked; the coil includes a coil portion defined by the plurality of conductor patterns that are shaped so as to be wound around the coil axis a plurality of times; at least one of the plurality of base materials includes the coil portion formed thereon; on the base material on which the coil portion is formed, an outer dummy pattern defined by the conductor pattern on an outer side of the coil portion, and an inner dummy pattern defined by the conductor pattern on an inner side of the coil portion are provided; and, in at least two perpendicular or substantially perpendicular axial directions along a surface of the base material, of the plurality of conductor patterns that define the coil portion:

a width of the outer dummy pattern is larger than a width of the conductor patterns of the coil portion;

a width of the inner dummy pattern is larger than the width of the conductor patterns of the coil portion;

a distance between the outer dummy pattern and the conductor pattern of the coil portion adjacent to the outer dummy pattern is smaller than or equal to a distance between the conductor patterns of the coil portion; and a distance between the inner dummy pattern and the conductor pattern of the coil portion adjacent to the inner dummy pattern is smaller than or equal to the width of the inner dummy pattern.

In a method for manufacturing a coil-incorporated multilayer substrate according to a preferred embodiment of the present invention, the coil-incorporated multilayer substrate includes a conductor pattern made of metal foil; a base material made of thermoplastic resin and including the conductor pattern; and a coil including a plurality of conductor patterns and configured by stacking a plurality of base materials, and the method includes a first step of preparing the plurality of base materials; a second step of forming the conductor pattern on a predetermined base material among the plurality of base materials; a third step of stacking the plurality of base materials to define a stacked body; and a fourth step of thermally pressing the stacked body and softening and bonding the base materials, and the coil includes a coil axis in a stacking direction in which the plurality of base materials are stacked; the coil includes a coil portion defined by the plurality of conductor patterns that are shaped so as to be wound around the coil axis a plurality of times; at least one of the plurality of base materials includes the coil portion formed thereon; on the base material on which the coil portion is formed, an innermost conductor pattern and an outer dummy pattern defined by the conductor pattern on an outer side of the coil portion are provided; and, in at least two perpendicular or substantially perpendicular axial directions along a surface of the base material, of the plurality of conductor patterns that define the coil portion:

a width of the innermost conductor pattern is larger than a width of the conductor patterns of the coil portion other than the innermost conductor pattern;

the width of the innermost conductor pattern is larger than or equal to a distance between the innermost conductor pattern and the conductor pattern adjacent to the innermost conductor pattern;

a width of the outer dummy pattern is larger than a width of the conductor patterns of the coil portion between the innermost conductor pattern and the outer dummy pattern; and a distance between the outer dummy pattern and the conductor pattern of the coil portion adjacent to the outer dummy pattern is smaller than or equal to a distance between the conductor patterns of the coil portion, except a distance between the innermost conductor pattern and the conductor pattern adjacent to the innermost conductor pattern.

In a method for manufacturing a coil-incorporated multilayer substrate according to a preferred embodiment of the present invention, the coil-incorporated multilayer substrate includes a conductor pattern made of metal foil; a base material made of thermoplastic resin and including the conductor pattern; and a coil including a plurality of conductor patterns and configured by stacking a plurality of base materials, and the method includes a first step of preparing the plurality of base materials; a second step of forming the conductor pattern on a predetermined base material among the plurality of base materials; a third step of stacking the plurality of base materials to define a stacked body; and a fourth step of thermally pressing the stacked body and softening and bonding the base materials, and the coil includes a coil axis in a stacking direction in which the plurality of base materials are stacked; the coil includes a coil portion defined by the plurality of conductor patterns that are shaped so as to be wound around the coil axis a plurality of times; at least one of the plurality of base materials includes the coil portion formed thereon; on the base material on which the coil portion is formed, an outermost conductor pattern, and an inner dummy pattern defined by the conductor pattern on an inner side of the coil portion are provided; and, in at least two perpendicular or substantially perpendicular axial directions along a surface of the base material, of the plurality of conductor patterns that defined the coil portion:

a width of the outermost conductor pattern is larger than a width of the conductor patterns of the coil portion other than the outermost conductor pattern;

a width of the inner dummy pattern is larger than or equal to a width of the conductor patterns of the coil portion between the outermost conductor pattern and the inner dummy pattern; and a distance between the inner dummy pattern and the conductor pattern of the coil portion adjacent to the inner dummy pattern is smaller than or equal to the width of the inner dummy pattern.

In a method for manufacturing a coil-incorporated multilayer substrate according to a preferred embodiment of the present invention, the coil-incorporated multilayer substrate includes a conductor pattern made of metal foil; a base material made of thermoplastic resin and including the conductor pattern; and a coil including a plurality of conductor patterns and configured by stacking a plurality of base materials, and the method includes a first step of preparing the plurality of base materials; a second step of forming the conductor pattern on a predetermined base material among the plurality of base materials; a third step of stacking the plurality of base materials to define a stacked body; and a fourth step of thermally pressing the stacked body and softening and bonding the base materials, and the coil includes a coil axis in a stacking direction in which the plurality of base materials are stacked; the coil includes a coil portion defined by the plurality of conductor patterns that are shaped so as to be wound around the coil axis a plurality of times; at least one of the plurality of base materials includes the coil portion formed thereon; on the base material on which the coil portion is formed, an outer dummy pattern defined by the conductor pattern on an outer side of the coil portion, and an inner dummy pattern defined by the conductor pattern on an inner side of the coil portion are provided; and, in at least two perpendicular or substantially perpendicular axial directions along a surface of the base material, of the plurality of conductor patterns that define the coil portion:

a width of the outer dummy pattern is larger than a width of the conductor patterns of the coil portion;

a width of the inner dummy pattern is larger than the width of the conductor patterns of the coil portion;

a distance between the inner dummy pattern and the conductor pattern of the coil portion adjacent to the inner dummy pattern is smaller than or equal to a distance between the conductor patterns of the coil portion; and a distance between the outer dummy pattern and the conductor pattern of the coil portion adjacent to the outer dummy pattern is smaller than or equal to a distance between the conductor patterns of the coil portion.

In a method for manufacturing a coil-incorporated multilayer substrate according to a preferred embodiment of the present invention, the coil-incorporated multilayer substrate includes a conductor pattern made of metal foil; a base material made of thermoplastic resin and including the conductor pattern; and a coil including a plurality of conductor patterns and configured by stacking a plurality of base materials, and the method includes a first step of preparing the plurality of base materials; a second step of forming the conductor pattern on a predetermined base material among the plurality of base materials; a third step of stacking the plurality of base materials to define a stacked body; and a fourth step of thermally pressing the stacked body and softening and bonding the base materials, and the coil includes a coil axis in a stacking direction in which the plurality of base materials are stacked; the coil includes a coil portion defined by the plurality of conductor patterns that are shaped so as to be wound around the coil axis a plurality of times; at least one of the plurality of base materials includes the coil portion formed thereon; on the base material on which the coil portion is formed, an outermost conductor pattern, and an inner dummy pattern defined by the conductor pattern on an inner side of the coil portion are provided; and, in at least two perpendicular or substantially perpendicular axial directions along a surface of the base material, of the plurality of conductor patterns that define the coil portion:

a width of the outermost conductor pattern is larger than a width of the conductor patterns of the coil portion other than the outermost conductor pattern;

a width of the inner dummy pattern is larger than the width of the conductor patterns of the coil portion between the outermost conductor pattern and the inner dummy pattern; and a distance between the inner dummy pattern and the conductor pattern of the coil portion adjacent to the inner dummy pattern is smaller than or equal to a distance between the conductor patterns of the coil portion.

According to the manufacturing methods of the preferred embodiments described above, coil-incorporated multilayer substrates that significantly reduce or prevent deformation of the conductor pattern caused by resin flow and stabilize electrical characteristics of the coil are obtained.

According to various preferred embodiments of the present invention, coil-incorporated multilayer substrates that significantly reduce or prevent deformation of the conductor pattern caused by resin flow and stabilize electrical characteristics of the coil are obtained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
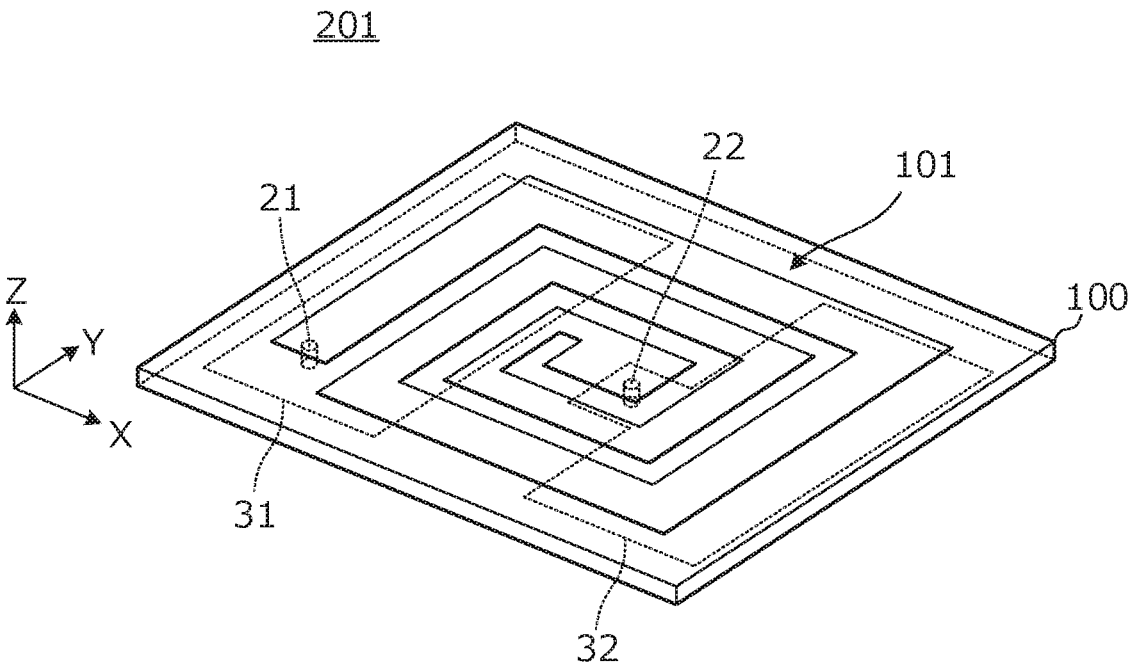
FIG. 1 is a perspective view of a coil-incorporated multilayer substrate 201 prior to formation of a protection film according to a first preferred embodiment of the present invention.

Hereinafter, a plurality of preferred embodiments of the present invention will be described with reference to the attached drawings and several specific examples. In the drawings, components and elements assigned with the same reference numerals or symbols will represent identical or similar components and elements. While preferred embodiments are separately described for the sake of convenience and to facilitate the description and understanding of the main points, constituent elements described in different preferred embodiments are able to be partially replaced and combined with each other. In preferred embodiments subsequent to the first preferred embodiment, a description of matters common to the first preferred embodiment is omitted, and only different points are described. In particular, the same operational effects by the same configuration will not be described individually for each preferred embodiment.

First Preferred Embodiment

Figure 2:
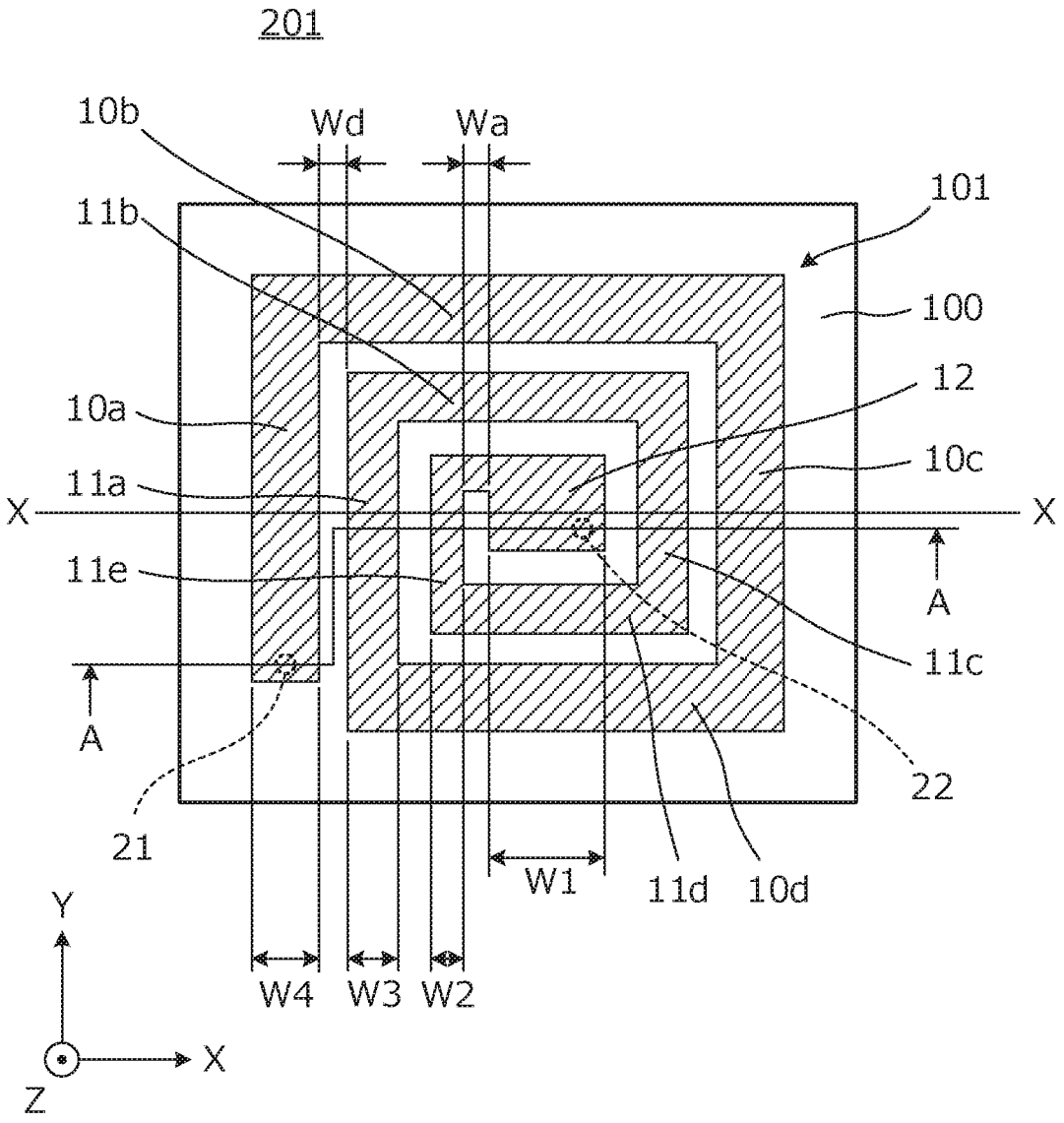
FIG. 2 is a plan view of the coil-incorporated multilayer substrate 201 prior to formation of a protection film according to the first preferred embodiment of the present invention.
Figure 3A:
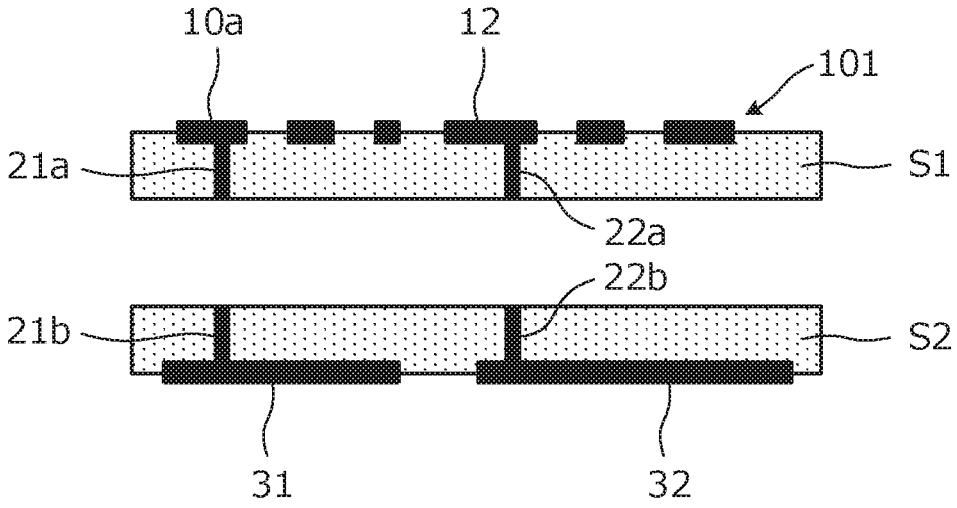
FIG. 3A is a cross-sectional view of a portion of the coil-incorporated multilayer substrate 201 in a manufacturing step, the portion being taken along a line A-A in FIG. 2.
Figure 3B:
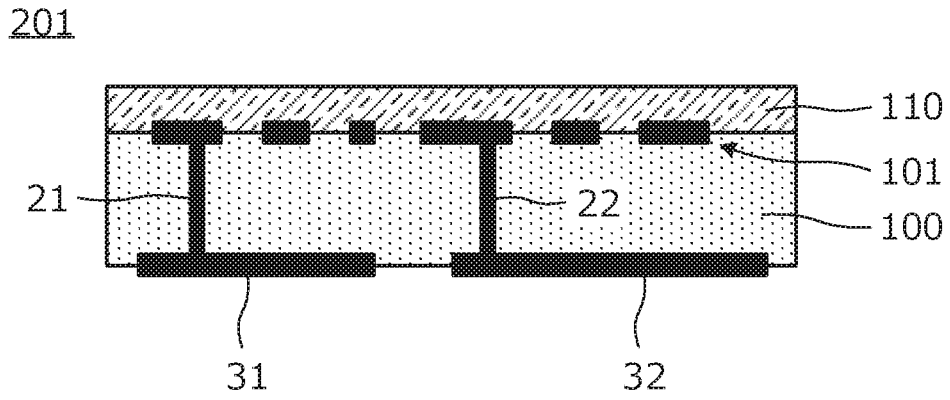
FIG. 3B is a cross-sectional view of the coil-incorporated multilayer substrate 201 taken along the line A-A in FIG. 2.

FIG. 1 is a perspective view of a coil-incorporated multilayer substrate 201 prior to formation of a protection film according to a first preferred embodiment of the present invention. FIG. 2 is a plan view of the coil-incorporated multilayer substrate 201 prior to formation of a protection film according to the first preferred embodiment of the present invention. FIG. 3A is a cross-sectional view of a portion of the coil-incorporated multilayer substrate 201 in a manufacturing step, the portion being taken along a line A-A in FIG. 2, and FIG. 3B is a cross-sectional view of the coil-incorporated multilayer substrate 201 taken along the line A-A in FIG. 2.

The coil-incorporated multilayer substrate 201 is preferably configured by stacking a plurality of base materials including base materials S1 and S2 of thermoplastic resin that is preferably made of liquid crystal polymers, for example, the base materials each including a conductor pattern, and includes a coil defined by the conductor pattern. Such a conductor pattern is obtained by patterning a metal foil (copper foil, for example) attached to the base material of thermoplastic resin.

The base material S1 preferably includes a rectangular or substantially rectangular spiral shaped coil portion 101 including conductor patterns 10*a*, 10*b*, 10*c*, 10*d*, 11*a*, 11*b*, 11*c*, 11*d*, 11*e*, and 12. The coil portion 101 includes a coil axis that is oriented in the stacking direction of the base materials S1 and S2, and has a shape in which the conductor patterns are wound around the coil axis a plurality of times on the base material S1.

Of the conductor patterns that define the coil portion, the conductor patterns 10*a*, 10*b*, 10*c*, and 10*d* are outermost conductor patterns, the conductor pattern 12 is an innermost conductor pattern, and the conductor patterns 11*a*, 11*b*, 11*c*, 11*d*, and 11*e* are conductor patterns between the outermost conductor pattern and the innermost conductor pattern.

In the X axis direction along the surface of the base material S1 of the coil portion 101 (in the line X-X in FIG. 2), the width of each of the conductor patterns preferably has the following relationships.

The width W4 of the outermost conductor patterns 10*a* and 10*c* is larger than the width W3 of the conductor patterns 11*a* and 11*c* between the innermost conductor pattern 12 and the outermost conductor pattern, and the width W2 of the conductor pattern 11*e* therebetween (W2<W4, W3<W4). It is to be noted that, even if the width of the conductor pattern is partially changed (the width of the conductor pattern 11*c*<the width of the conductor pattern 11*a*), the relationships of W2<W4 and W3<W4 are always satisfied.

The width W1 of the innermost conductor pattern 12 is larger than the width W3 of the conductor patterns 11*a* and 11*c* between the outermost conductor patterns 10*a* and 10*c* and the innermost conductor pattern and the width W2 of the conductor pattern 11*e* therebetween (W2<W1, W3<W1). It is to be noted that, even if the width of the conductor pattern is partially changed (the width of the conductor pattern 11*c*<the width of the conductor pattern 11*a*), the relationships of W2<W1 and W3<W1 are always satisfied.

The width W1 of the innermost conductor pattern 12 is larger than or equal to the distance Wa between the innermost conductor pattern 12 and the conductor patterns 11*e* and 11*c* adjacent to the innermost conductor pattern 12 (Wa≤W1). It is to be noted that, even if the width W1 of the conductor pattern 12 or the distance Wa is partially changed, the relationship of Wa W1 is always satisfied.

The distance Wd between the outermost conductor patterns 10*a*, 10*b*, 10*c*, and 10*d* and the conductor pattern of the coil portion 101 adjacent to the outermost conductor patterns 10*a*, 10*b*, 10*c*, and 10*d* is smaller than or equal to the width W4 of the outermost conductor pattern (Wd≤W4). It is to be noted that, even if the width W4 of the conductor pattern or the distance Wd is partially changed, the relationship of Wd≤W4 is always satisfied.

The base material S2, as illustrated in FIG. 3A, includes terminal electrodes 31 and 32 on the bottom surface of the base material S2. The base materials S1 and S2 include interlayer connection conductors 21*a*, 21*b*, 22*a*, and 22*b* that cause the terminal electrodes 31 and 32 to be electrically connected to the conductor patterns 10*a* and 12.

The base materials S1 and S2 illustrated in FIG. 3A are thermally pressed to join the base materials S1 and S2, which thus provides a stacked body 100. Subsequently, as illustrated in FIG. 3B, a protection film 110, such as an epoxy resin, for example, is provided in the stacked body 100 so as to protect the coil portion 101. It is to be noted that the protection film 110 is arbitrarily provided.

Figure 4:
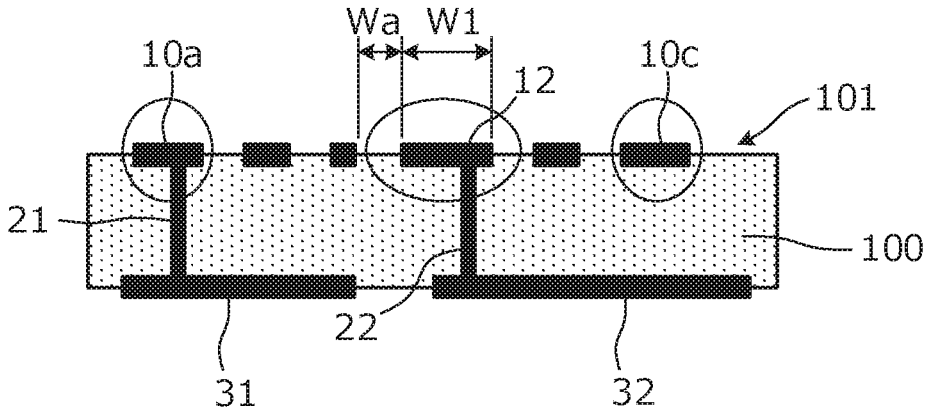
FIG. 4 is a cross-sectional view of the coil-incorporated multilayer substrate 201 prior to formation of a protection film according to the first preferred embodiment of the present invention.

FIG. 4 is a cross-sectional view of the coil-incorporated multilayer substrate 201 prior to formation of a protection film. The cross-sectional surface of the coil-incorporated multilayer substrate 201 is equivalent to a portion taken along a line A-A in FIG. 2. Although resin flow occurs in the base materials S1 and S2 of thermoplastic resin at the time of thermal pressing, the flow resistance of resin is high at the interface of the base material and the conductor pattern. Therefore, the outermost conductor patterns 10*a* and 10*c* with a large width and the innermost conductor pattern 12 with a large width fix the resin that is about to flow at the time of the thermal pressing.

Since the width of each conductor pattern preferably has the above relationships, the resin that is about to flow is effectively fixed by the outermost conductor patterns 10*a* and 10*c* with a large width and the innermost conductor pattern 12 with a large width. This significantly reduces or prevents the deformation of the conductor pattern caused by resin flow, the conductor pattern including the conductor patterns 11*a*, 11*c*, and 11*e* provided between the outermost conductor patterns 10*a* and 10*c* with a large width and the innermost conductor pattern 12 with a large width.

Moreover, since the interlayer connection conductors 21 and 22 are connected to the outermost conductor pattern 10*a* and the innermost conductor pattern 12, the fluid resin is further fixed by the interlayer connection conductors 21 and 22.

It is to be noted that the distance Wd (as illustrated in FIG. 2) between the outermost conductor pattern and the conductor pattern of the coil portion adjacent to the outermost conductor pattern is preferably smaller than or equal to the width W4 (as illustrated in FIG. 2) of the outermost conductor pattern (Wd≤W4), so that the effect of significantly reducing or preventing the resin from flowing by the outermost conductor pattern, and the deformation of the conductor pattern due to the resin flow is significantly reduced or prevented.

In addition, the width W4 of the outermost conductor patterns 10*a* and 10*c* may preferably be, for example, about 1.3 times larger than the width W3 of the conductor patterns 11*a* and 11*c* and the width W2 of the conductor pattern 11*e*, the conductor patterns being inner conductor patterns except the innermost conductor pattern 12. Similarly, the width W1 of the innermost conductor pattern 12 may preferably be, for example, about 1.3 times larger than the width W3 of the conductor patterns 11*a* and 11*c* and the width W2 of the conductor pattern 11*e*, the conductor patterns being outer conductor patterns except the outermost conductor patterns 10*a* and 10*c*. Accordingly, since the width W4 of the outer conductor patterns 10*a* and 10*c* and the width W3 of the inner conductor patterns 11*a* and 11*c* except the innermost conductor pattern 12 are able to be sufficiently larger than the width W2 of the conductor pattern 11*e*, the deformation of the conductor pattern caused by resin flow is able to be further stably reduced or prevented. In addition, the width of the outer conductor pattern is made large while the number of winding turns per occupation area is secured, so that the path length rate of the wide portion in the conductor pattern of the coil portion is able to be large, and thus, conductor loss is able to be reduced.

According to the first preferred embodiment of the present invention, as compared with a case in which an inner dummy pattern and an outer dummy pattern that are described below are provided, an area in which the coil is provided is easily made larger and the number of turns (the number of windings) of the coil is also easily increased. Thus, sufficient coil characteristics are easily obtained.

While the above example describes that, in the X axis direction along the surface of the base material S1 of the coil portion 101 (in the line X-X in FIG. 2), the width of each conductor pattern satisfies the relationships described above, the relationships are applicable not only in the X axis direction but also in the Y axial direction. In addition, the relationships are applicable in a similar manner in a determined direction along the surface of the base material S1 of the coil portion 101, such as the oblique direction with respect to the X-axis direction and the Y axial direction in FIG. 2, for example.

Figure 5A:
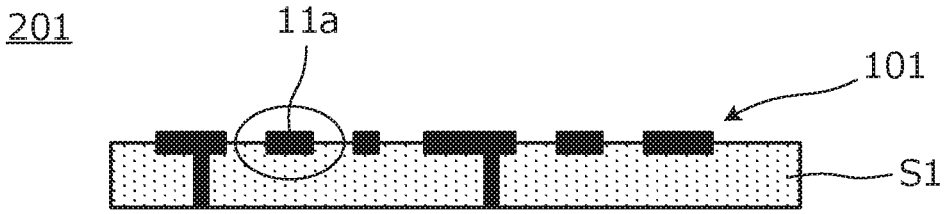
FIG. 5A is a cross-sectional view of a base material S1 on which a coil portion 101 is provided.
Figure 5B:
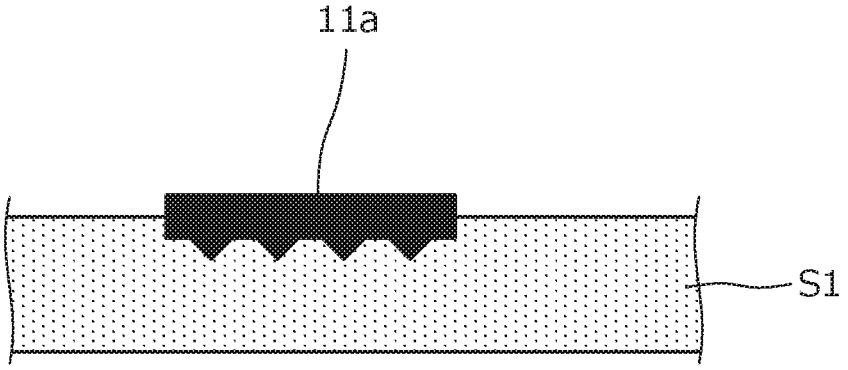
FIG. 5B is an enlarged view of an elliptical portion in FIG. 5A.

FIG. 5A is a sectional view of the base material S1 on which the coil portion 101 is provided. FIG. 5B is an enlarged view of an elliptical portion in FIG. 5A. Each conductor pattern of the coil portion 101 includes a contact surface in contact with the base material S1 and a non-contact surface not in contact with the base material S1 and the surface roughness of the contact surface is preferably larger than the surface roughness of the non-contact surface. Accordingly, the force of fixing the resin that is about to flow by a conductor pattern is increased, and the deformation of the conductor pattern caused by the resin flow is significantly reduced or prevented effectively. In addition, the surface roughness of the non-contact surface that is not contact with the base material S1 is relatively small, so that conductor loss (transmission loss) of the coil portion does not become large.

A non-limiting example of a method for manufacturing the coil-incorporated multilayer substrate 201 according to the first preferred embodiment of the present invention is as follows.

As illustrated in FIG. 3A, base materials S1 and S2 preferably made of liquid crystal polymer, for example, are prepared. A metal foil (copper foil, for example) is previously attached to each of the base materials S1 and S2. The metal foil includes a contact surface in contact with the base materials S1 and S2 and a non-contact surface not in contact with the base materials S1 and S2 and the contact surface has the surface roughness larger than the non-contact surface.

The metal foil attached to the base material of thermoplastic resin is patterned using a technology such as photolithography, for example, to form various conductor patterns of the coil portion 101 on the base material S1. In addition, a through hole is bored, for example, by laser from the surface to which the metal foil of the base material S1 is not attached and the through hole is filled up with conductive paste to form interlayer connection conductors 21*a* and 22*a* in the base material S1. Moreover, a method similar to the method for manufacturing the base material S1 is used to also form terminal electrodes 31 and 32 made of metal foil and interlayer connection conductors 21*b* and 22*b* made of conductive paste in the base material S2.

The base materials S1 and S2 are stacked to form a stacked body 100.

The stacked body 100 is thermally pressed to soften and bond the base materials S1 and S2. At this time, the conductive paste with which the through hole has been filled up solidifies (is metallized).

The above steps are processed in a collective substrate state. The base material in the collective substrate state is divided to obtain an individual coil-incorporated multilayer substrate 201.

Second Preferred Embodiment

A second preferred embodiment of the present invention is an example in which the coil portion is provided over two or more layers.

Figure 6:
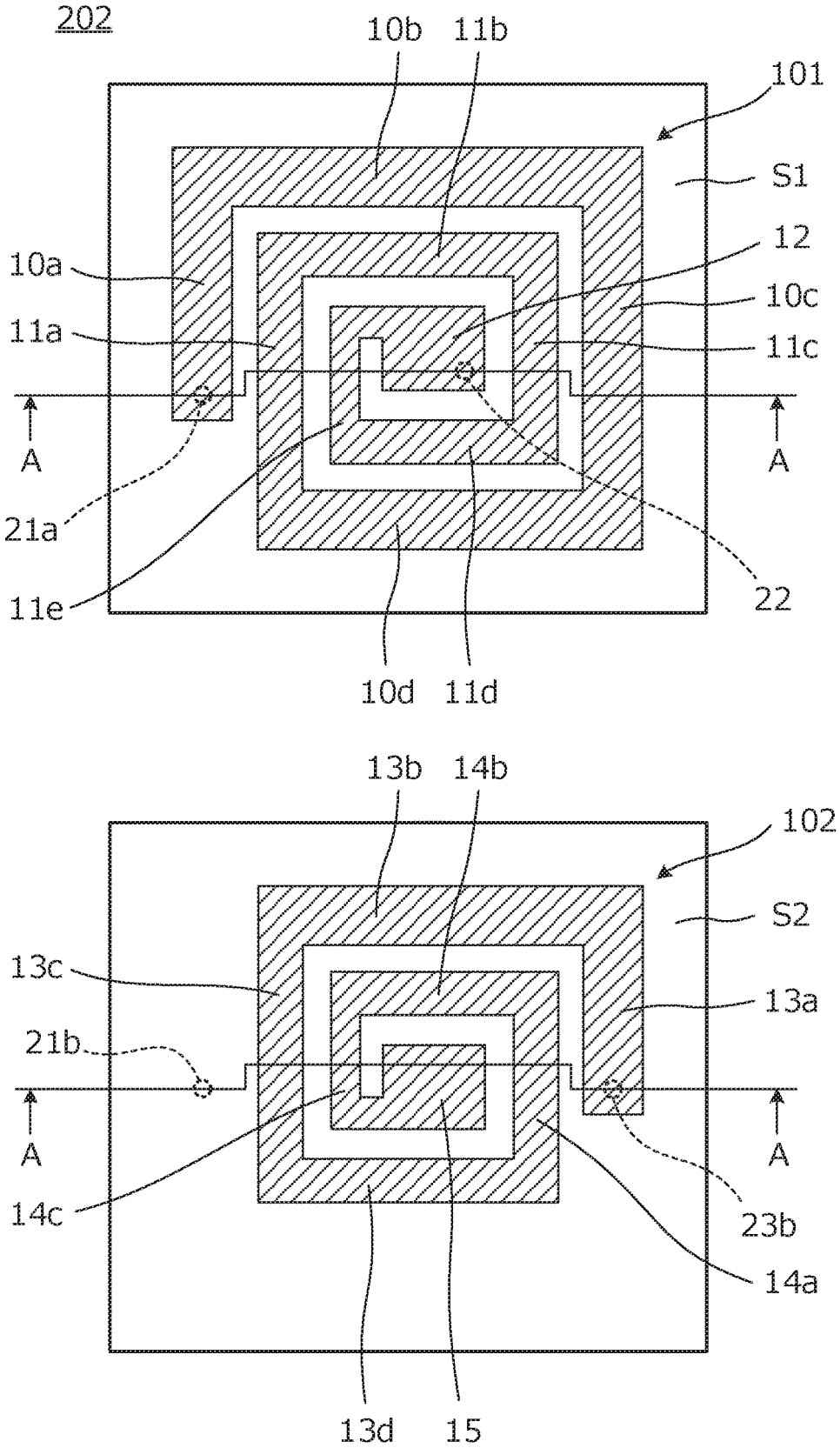
FIG. 6 is a plan view of each of base material layers that define a coil-incorporated multilayer substrate 202 according to a second preferred embodiment of the present invention.
Figure 7A:
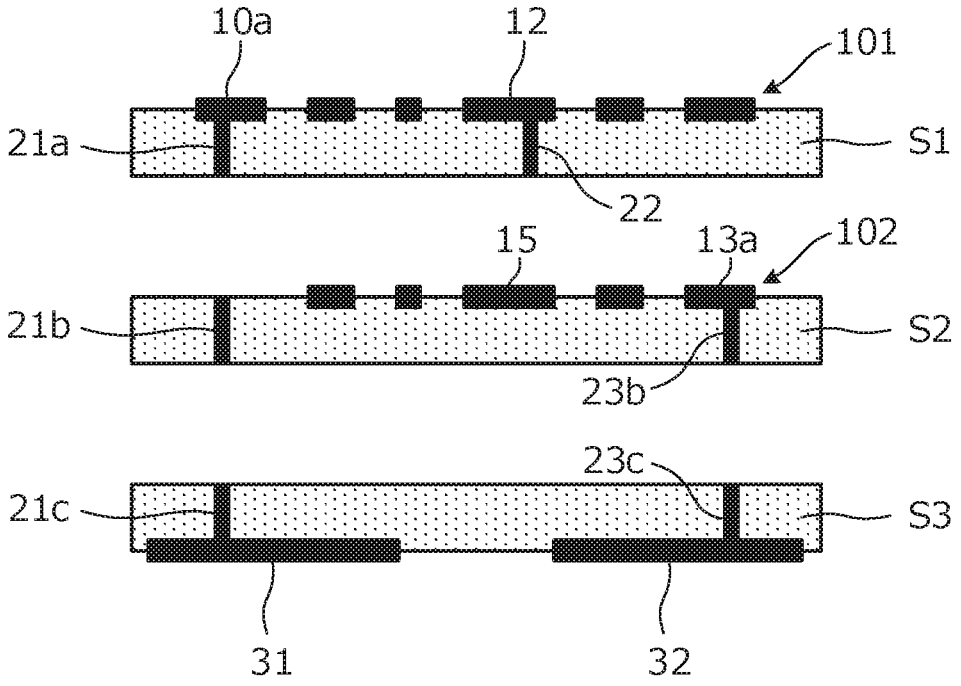
FIG. 7A is a cross-sectional view of a portion of the coil-incorporated multilayer substrate 202 in a manufacturing step, the portion being taken along a line A-A in FIG. 6.
Figure 7B:
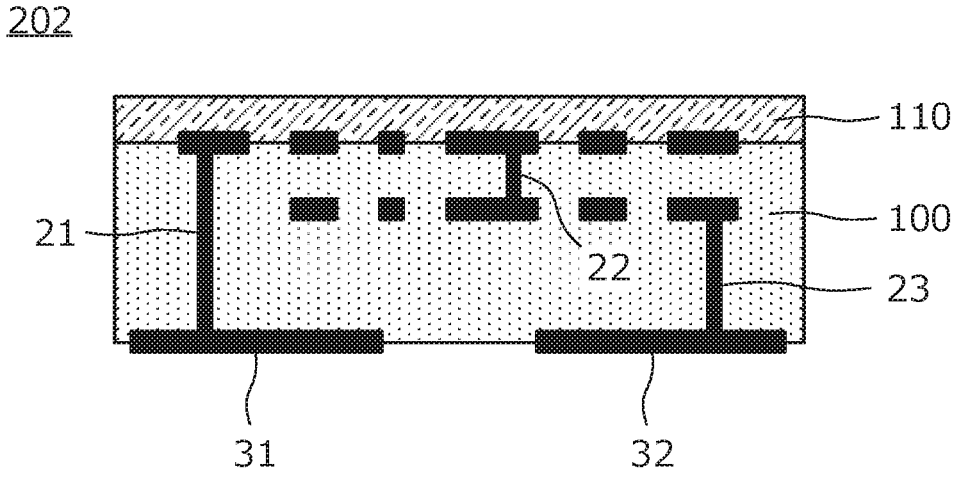
FIG. 7B is a cross-sectional view of the coil-incorporated multilayer substrate 202 taken along the line A-A in FIG. 6.

FIG. 6 is a plan view of each of base material layers of a coil-incorporated multilayer substrate 202 according to the second preferred embodiment of the present invention. FIG. 7A is a cross-sectional view of a portion of the coil-incorporated multilayer substrate 202 in a manufacturing step, the portion being taken along a line A-A in FIG. 6, and FIG. 7B is a cross-sectional view of the coil-incorporated multilayer substrate 202 taken along the line A-A in FIG. 6.

The coil-incorporated multilayer substrate 202 is preferably configured by stacking a plurality of base materials including base materials S1, S2, and S3 of thermoplastic resin, the base materials each including a conductor pattern, and includes a coil defined by the conductor pattern.

The base material S1 preferably includes a rectangular or substantially rectangular spiral shaped coil portion 101 including conductor patterns 10*a*, 10*b*, 10*c*, 10*d*, 11*a*, 11*b*, 11*c*, 11*d*, 11*e*, and 12. The base material S2 includes a rectangular or substantially rectangular spiral coil portion 102 including conductor patterns 13*a*, 13*b*, 13*c*, 13*d*, 14*a*, 14*b*, 14*c*, and 15.

Of the conductor patterns that define the coil portion 101, the conductor patterns 10*a*, 10*b*, 10*c*, and 10*d* are outermost conductor patterns, the conductor pattern 12 is an innermost conductor pattern, and the conductor patterns 11*a*, 11*b*, 11*c*, 11*d*, and 11*e* are conductor patterns between the outermost conductor pattern and the innermost conductor pattern. In addition, of the conductor patterns that define the coil portion 102, the conductor patterns 13*a*, 13*b*, 13*c*, and 13*d* are outermost conductor patterns, the conductor pattern 15 is an innermost conductor pattern, and the conductor patterns 14*a*, 14*b*, and 14*c* are conductor patterns between the outermost conductor pattern and the innermost conductor pattern.

The coil portions 101 and 102 each include a coil axis that is oriented in the stacking direction of the base materials S1 and S2, and have a shape in which the conductor patterns are wound around the coil axis a plurality of times on the base materials S1 and S2.

The base material S3, as illustrated in FIG. 7A, includes terminal electrodes 31 and 32 on the bottom surface of the base material S3. The base materials S1, S2, and S3 include interlayer connection conductors 21*a*, 21*b*, and 21*c* that cause the terminal electrode 31 to be electrically connected to the conductor pattern 10*a*. The base materials S2 and S3 include interlayer connection conductors 23*b* and 23*c* that cause the terminal electrode 32 to be electrically connected to the conductor pattern 13*a*. In addition, the base material S1 includes an interlayer connection conductor that causes the conductor pattern 15 to be electrically connected to the conductor pattern 12.

The coil-incorporated multilayer substrate 202 according to the second preferred embodiment of the present invention, similarly to the first preferred embodiment, also provides a stacked body 100 by thermally pressing the base materials S1, S2, and S3 illustrated in FIG. 7A. As illustrated in FIG. 7B, the stacked body 100 is protected by a protection film 110.

As in the second preferred embodiment, in the case in which the coil portion is provided over two or more layers, each layer may preferably satisfy the relationships described above. Accordingly, a change in the interlayer capacitance between the coil portions 101 and 102 caused by resin flow is also able to be significantly reduced or prevented.

Third Preferred Embodiment

A third preferred embodiment of the present invention is an example of a coil-incorporated multilayer substrate that includes an outer dummy pattern and an inner dummy pattern.

Figure 8:
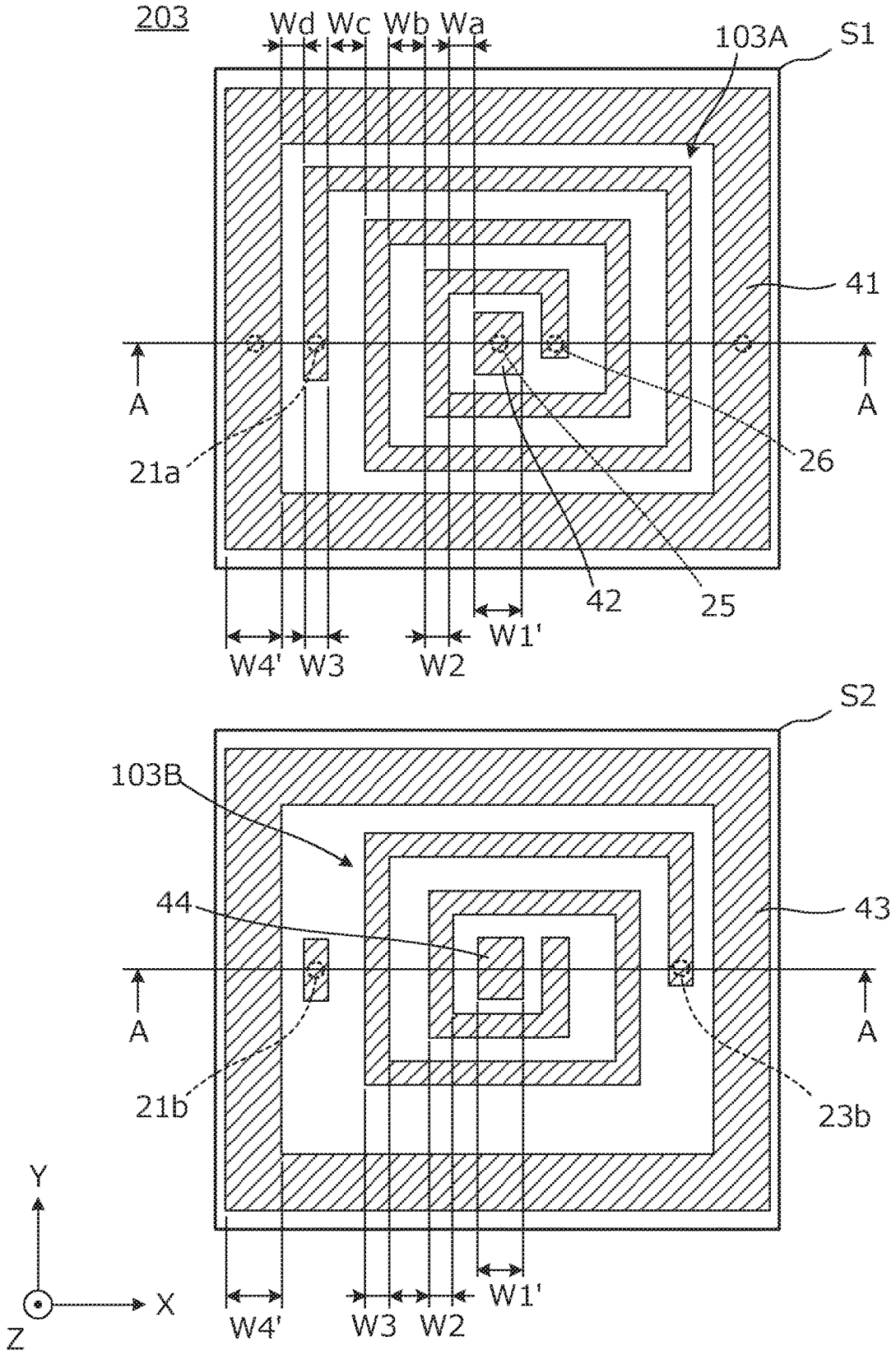
FIG. 8 is a plan view of each of base material layers that define a coil-incorporated multilayer substrate 203 according to a third preferred embodiment of the present invention.
Figure 9A:
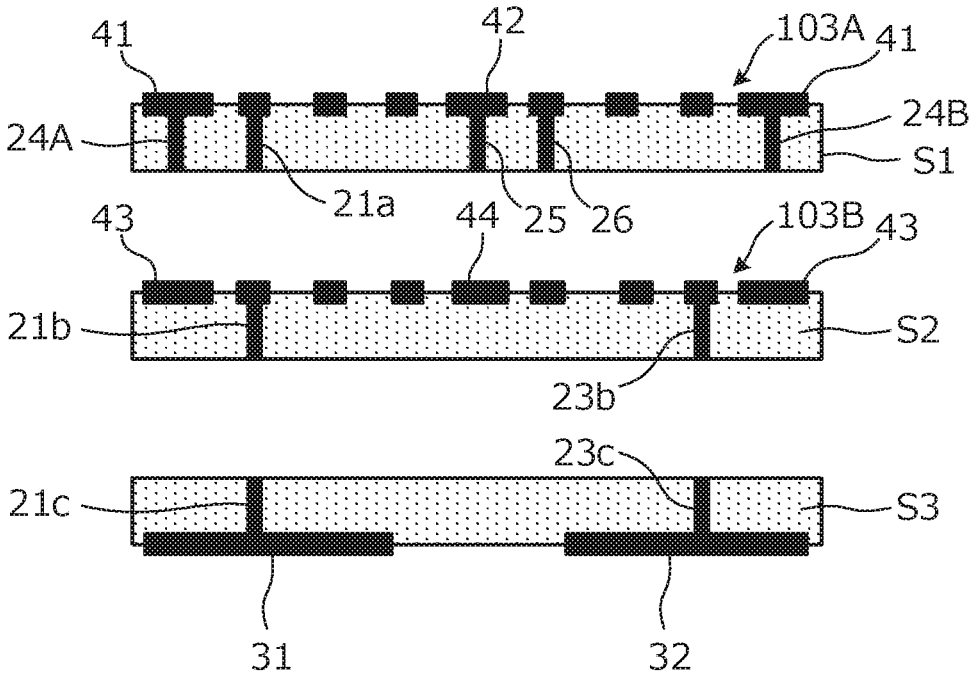
FIG. 9A is a cross-sectional view of a portion of the coil-incorporated multilayer substrate 203 in a manufacturing step, the portion being taken along a line A-A in FIG. 8.
Figure 9B:
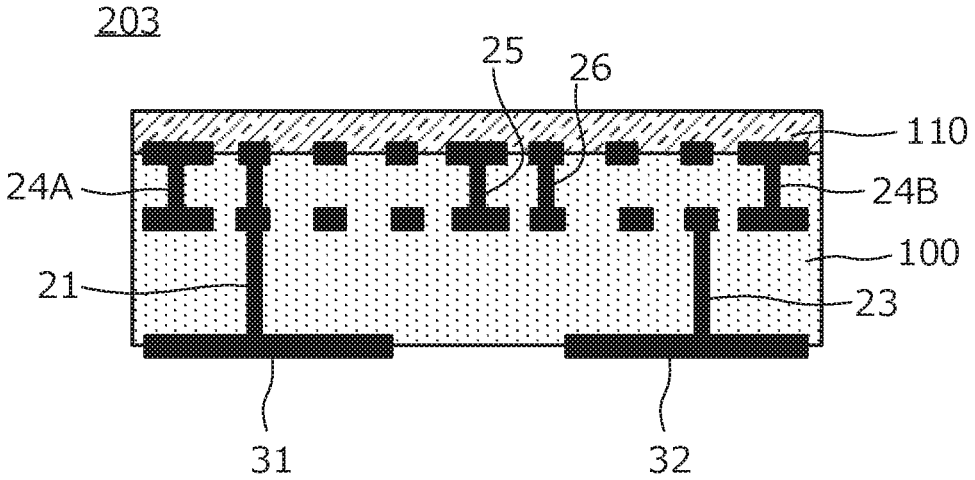
FIG. 9B is a cross-sectional view of the coil-incorporated multilayer substrate 203 taken along the line A-A in FIG. 8.

FIG. 8 is a plan view of each of base material layers included in a coil-incorporated multilayer substrate 203 according to the third preferred embodiment of the present invention. FIG. 9A is a cross-sectional view of a portion of the coil-incorporated multilayer substrate 203 in a manufacturing step, the portion being taken along a line A-A in FIG. 8, and FIG. 9B is a cross-sectional view of the coil-incorporated multilayer substrate 203 taken along the line A-A in FIG. 8.

The coil-incorporated multilayer substrate 203 is preferably configured by stacking a plurality of base materials including base materials S1, S2, and S3 of thermoplastic resin, the base materials each including a conductor pattern, and includes a coil defined by the conductor pattern.

The base material S1 includes a coil portion 103A preferably defined by rectangular or substantially rectangular spiral shaped conductor patterns; an outer dummy pattern 41 defined by a conductor pattern on the outer side of the coil portion 103A; and an inner dummy pattern 42 defined by a conductor pattern on the inner side of the coil portion 103A.

The base material S2 includes a coil portion 103B preferably defined by rectangular or substantially rectangular spiral shaped conductor patterns; an outer dummy pattern 43 defined by a conductor pattern on the outer side of the coil portion 103B; and an inner dummy pattern 44 defined by a conductor pattern on the inner side of the coil portion 103B.

It is to be noted that the "dummy pattern" in the specification is not electrically connected to the conductor pattern that defines a coil, but is electrically independent.

In the X axis direction along the surface of the base material S1 of the coil portion 103A (in the line A-A in FIG. 8), the width of each of the conductor patterns preferably has the following relationships.

The width W4' of the outer dummy pattern 41 is larger than the widths W2 and W3 of the conductor patterns of the coil portion 103A (W2<W4', W3<W4'). It is to be noted that, even if the width of the conductor pattern is partially changed, the relationships of W2<W4' and W3<W4' are always satisfied.

The width W1' of the inner dummy pattern 42 is larger than the widths W2 and W3 of the conductor patterns of the coil portion 103A (W2<W1', W3<W1'). It is to be noted that, even if the width of the conductor pattern is partially changed, the relationships of W2<W1' and W3<W1' are always satisfied.

The distance Wd between the outer dummy pattern and the conductor pattern of the coil portion adjacent to the outer dummy pattern is smaller than or equal to the distance Wc between the conductor patterns of the coil portion (Wd≤Wc). It is to be noted that, even if the distances Wd and Wc are partially changed, the relationship of Wd≤Wc is always satisfied.

The distance Wa between the inner dummy pattern and the conductor pattern of the coil portion adjacent to the inner dummy pattern is smaller than or equal to the width W1' of the inner dummy pattern (Wa≤W1'). It is to be noted that, even if the distances Wa and the width W1' of the inner dummy pattern are partially changed, the relationship of Wa W1' is always satisfied.

Although it is preferable that the above relationships should also be applied to the coil portion 103B, it is not always necessary to satisfy all of the relationships. In other words, according to preferred embodiments of the present invention, it is possible to achieve the desired effect if the coil-incorporated multilayer substrate includes one or more layers that satisfy the above relationship.

The base material S3, as illustrated in FIG. 9A, includes terminal electrodes 31 and 32 on the bottom surface of the base material S3. The base materials S1, S2, and S3 include interlayer connection conductors 21*a*, 21*b*, and 21*c* that cause the terminal electrode 31 to be electrically connected to the outer peripheral end of the coil portion 103A. The base materials S2, and S3 include interlayer connection conductors 23*b* and 23*c* that cause the terminal electrode 32 to be electrically connected to the outer peripheral end of the coil portion 103B. In addition, the base material S1 includes interlayer connection conductors 24A and 24B that cause the outer dummy patterns 41 and 43 to be electrically connected to each other and an interlayer connection conductor 25 that causes the inner dummy patterns 42 and 44 to be electrically connected to each other. The base material S1 includes an interlayer connection conductor 26 that connects the inner peripheral end of the coil portion 103A and the inner peripheral end of the coil portion 103B.

The coil-incorporated multilayer substrate 203 according to the third preferred embodiment of the present invention, similarly to the first preferred embodiment, also provides a stacked body 100 by thermally pressing the base materials S1, S2, and S3 illustrated in FIG. 9A. As illustrated in FIG. 9B, the stacked body 100 is protected by a protection film 110.

Although resin flow occurs in the base materials S1, S2, and S3 of thermoplastic resin at the time of thermal pressing, the flow resistance of resin is high at the interface of the base material and the conductor pattern. Therefore, the outer dummy patterns 41 and 43 and the inner dummy patterns 42 and 44 fix the resin that is about to flow at the time of thermal pressing.

Since the width of each conductor pattern has the above relationships, the resin that is about to flow is effectively fixed by the outer dummy patterns 41 and 43 with a large width and the inner dummy patterns 42 and 44 with a large width. This significantly reduces or prevents the deformation of the conductor pattern caused by resin flow, the conductor pattern including the conductor patterns of the coil portions 103A and 103B provided between the outer dummy patterns 41 and 43 with a large width and the inner dummy patterns 42 and 44 with a large width.

Moreover, since the interlayer connection conductors 24A, 24B, and 25 are connected to the outer dummy patterns 41 and 43 and the inner dummy patterns 42 and 44, the fluid resin is further fixed by the interlayer connection conductors 24A, 24B, and 25.

It is to be noted that the width W4' of the outer dummy pattern 41 may preferably be, for example, about 1.3 times larger than the widths W2 and W3 of the conductor patterns of the coil portion 103A. Similarly, the width W1' of the inner dummy pattern 42 may preferably be, for example, about 1.3 times larger than the widths W2 and W3 of the conductor patterns of the coil portion 103A. Accordingly, since the width W4' of the outer dummy pattern 41 and the width W1' of the inner dummy pattern 42 are able to be sufficiently larger than the widths W2 and W3 of the conductor patterns of the coil portion 103A, the deformation of the conductor pattern caused by resin flow is able to further stably reduced or prevented.

While the above example describes that, in the X axis direction along the surface of the base materials S1 and S2 of the coil portions 103A and 103B (in the line A-A in FIG. 8), the width of each conductor pattern satisfies the relationships described above, the relationships are applicable not only in the X axis direction but also in the Y axial direction. In addition, the relationships are applicable in a similar manner in a determined direction along the surface of the base materials S1 and S2 of the coil portions 103A and 103B, such as the oblique direction with respect to the X-axis direction and the Y axial direction in FIG. 8, for example.

As in the third preferred embodiment, in the case in which the coil portion is provided over two or more layers, each layer may preferably satisfy the relationships described above.

Fourth Preferred Embodiment

A fourth preferred embodiment of the present invention is an example of a coil-incorporated multilayer substrate not including an inner dummy pattern and including an outer dummy pattern.

Figure 10:
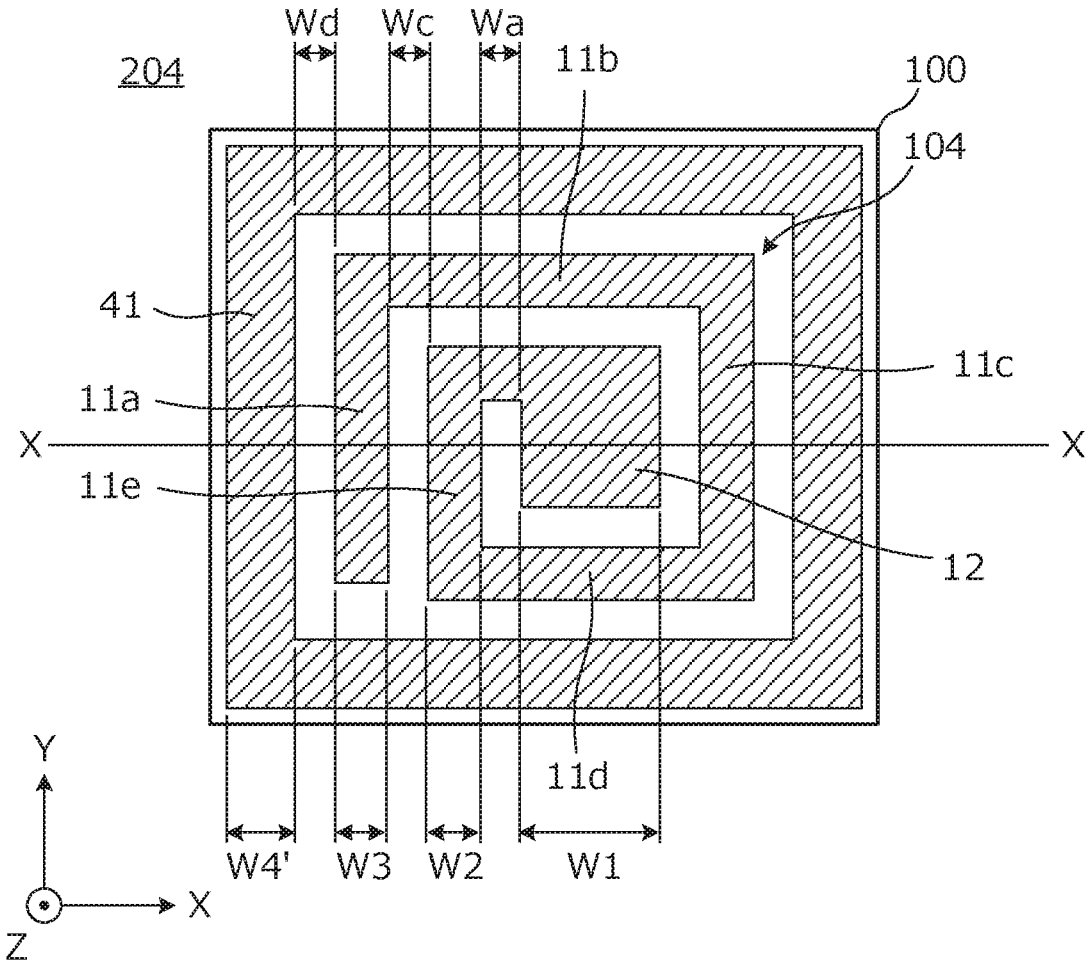
FIG. 10 is a plan view of a coil-incorporated multilayer substrate 204 according to a fourth preferred embodiment of the present invention.

FIG. 10 is a plan view of the coil-incorporated multilayer substrate 204 according to the fourth preferred embodiment of the present invention. The coil-incorporated multilayer substrate 204 has a stacked body 100 preferably configured by stacking a plurality of base materials made of thermoplastic resin and each including a conductor pattern.

The stacked body 100 includes a coil portion 104 preferably including rectangular or substantially rectangular spiral shaped conductor patterns, and an outer dummy pattern 41 defined by a conductor pattern on the outer side of the coil portion 104.

In the X axis direction along the surface of the stacked body 100 of the coil portion 104 (in the line X-X in FIG. 10), the width of each of the conductor patterns has the following relationships.

The width W1 of the innermost conductor pattern 12 is larger than the widths W2 and W3 of the conductor patterns of the coil portion 104 other than the innermost conductor pattern (W2<W1', W3<W1').

The width W1 of the innermost conductor pattern 12 is larger than or equal to the distance Wa between the innermost conductor pattern 12 and the conductor patterns 11*e* and 11*c* adjacent to the innermost conductor pattern 12 (Wa≤W1). It is to be noted that, even if the width of the conductor pattern is partially changed, the relationship of Wa≤W1 is always satisfied.

The width W4' of the outer dummy pattern 41 is larger than the widths W2 and W3 of the conductor patterns of the coil portion 104 (W2<W4', W3<W4'). It is to be noted that, even if the width of the conductor pattern is partially changed, the relationships of W2<W4' and W3<W4' are always satisfied.

The distance Wd between the outer dummy pattern 41 and the conductor pattern of the coil portion adjacent to the outer dummy pattern 41 is smaller than or equal to the distance Wc between the conductor patterns of the coil portion (Wd≤Wc). It is to be noted that, even if the distances Wd and Wc are partially changed, the relationship of Wd≤Wc is always satisfied.

The coil-incorporated multilayer substrate 204 according to the fourth preferred embodiment of the present invention, similarly to the first preferred embodiment, also provides a stacked body by thermally pressing a plurality of base materials. Although resin flow occurs in the base materials made of thermoplastic resin at the time of thermal pressing, the outer dummy pattern 41 and the innermost conductor pattern 12 fix the resin that is about to flow at the time of the thermal pressing.

Since the width of each conductor pattern has the relationships described above, the resin that is about to flow is effectively fixed by the outer dummy pattern 41 with a large width and the innermost conductor pattern 12 with a large width. This significantly reduces or prevents the deformation of the conductor pattern caused by resin flow, the conductor pattern including the conductor patterns 11*a*, 11*b*, 11*c*, 11*d*, and 11*e* provided between the outer dummy pattern 41 with a large width and the innermost conductor pattern 12 with a large width.

According to the fourth preferred embodiment provided with the outer dummy pattern 41, as compared to a case in which the width of the conductor pattern or distance between the conductor patterns is determined only by the width of the conductor pattern of the coil portion 104, the flexibility of the shape and arrangement of a conductor pattern is high.

Fifth Preferred Embodiment

A fifth preferred embodiment of the present invention is an example of a coil-incorporated multilayer substrate not including an outer dummy pattern and including an inner dummy pattern.

Figure 11:
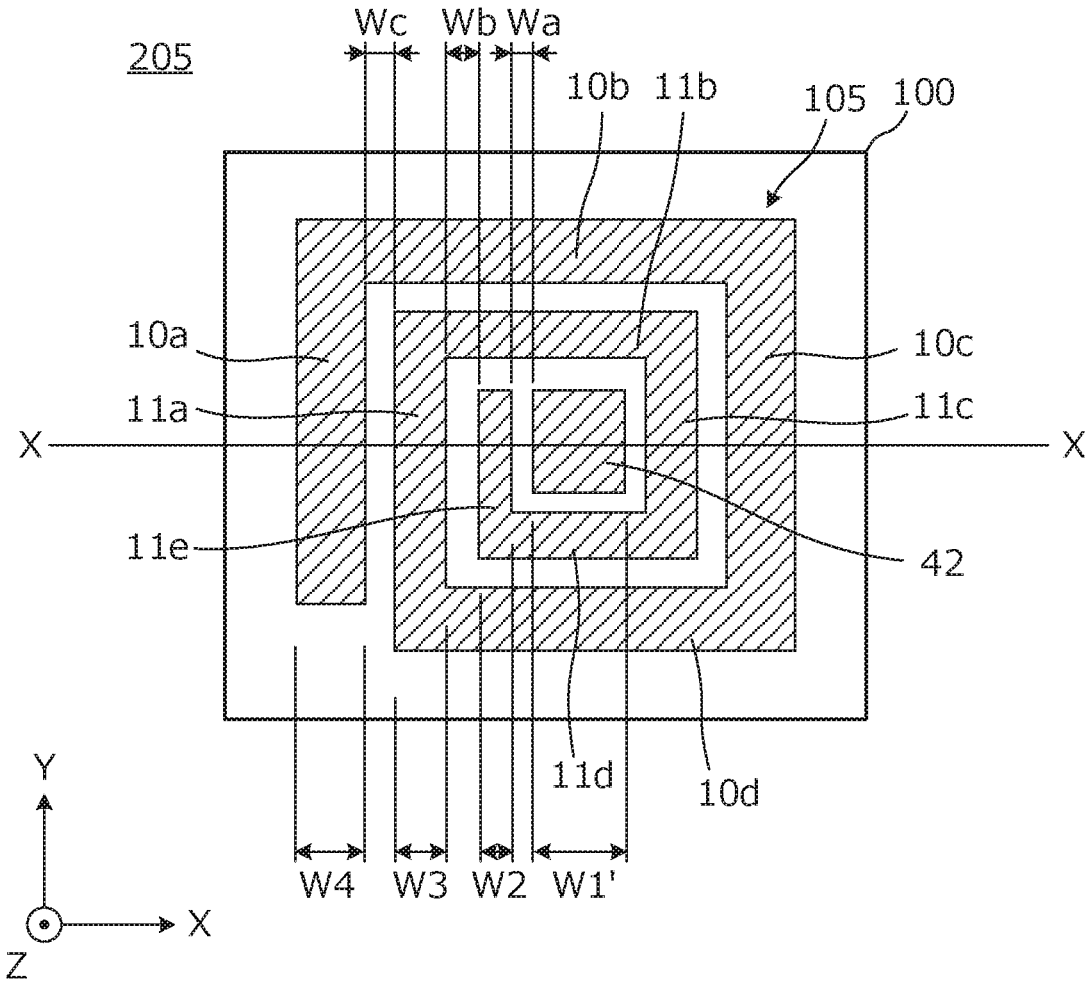
FIG. 11 is a plan view of a coil-incorporated multilayer substrate 205 according to a fifth preferred embodiment of the present invention.

FIG. 11 is a plan view of a coil-incorporated multilayer substrate 205 according to the fifth preferred embodiment of the present invention. The coil-incorporated multilayer substrate 205 includes a stacked body 100 preferably configured by stacking a plurality of base materials made of thermoplastic resin and each including a conductor pattern.

The stacked body 100 includes a coil portion 105 preferably including rectangular or substantially rectangular spiral shaped conductor patterns, and an inner dummy pattern 42 defined by a conductor pattern on the inner side of the coil portion 105.

In the X axis direction along the surface of the stacked body 100 of the coil portion 105 (in the line X-X in FIG. 11), the width of each of the conductor patterns has the following relationships.

The width W4 of the outermost conductor patterns is larger than the widths W2 and W3 of the conductor patterns of the coil portion 105 other than the outermost conductor patterns (W2<W4', W3<W4').

The width W1' of the inner dummy pattern 42 is larger than the widths W2 and W3 of the conductor patterns of the coil portion 105 (W2<W1', W3<W1').

The distance Wa between the inner dummy pattern 42 and the conductor pattern of the coil portion 105 adjacent to the inner dummy pattern 42 is smaller than or equal to the width W1' of the inner dummy pattern 42 (Wa≤W1').

The distance Wa between the inner dummy pattern 42 and the conductor pattern of the coil portion 105 adjacent to the inner dummy pattern 42 is smaller than or equal to the distance Wb between the conductor patterns of the coil portion 105 (Wa≤Wb).

A plurality of base materials are thermally pressed to provide a stacked body. Although resin flow occurs in the base materials made of thermoplastic resin at the time of thermal pressing, the inner dummy pattern 42 and the outermost conductor patterns 10*a*, 10*b*, 10*c*, and 10*d* fix the resin that is about to flow at the time of the thermal pressing.

Since the width of each conductor pattern has the relationships described above, the resin that is about to flow is effectively fixed by the inner dummy pattern 42 with a large width and the outermost conductor patterns 10*a*, 10*b*, 10*c*, and 10*d* with a large width. This significantly reduces or prevents the deformation of the conductor pattern caused by resin flow, the conductor pattern including the conductor patterns 11*a*, 11*b*, 11*c*, 11*d*, and 11*e* provided between the inner dummy pattern 42 with a large width and the outermost conductor patterns 10*a*, 10*b*, 10*c*, and 10*d* with a large width. In particular, in the fifth preferred embodiment, since the distance Wa between the inner dummy pattern 42 and the conductor pattern of the coil portion 105 adjacent to the inner dummy pattern 42 is smaller than or equal to the distance Wb between the conductor patterns of the coil portion 105 (Wa≤Wb), the effect of significantly reducing or preventing the resin from flowing by the inner dummy pattern 42 is increased. Therefore, the deformation of a portion adjacent to the inner dummy pattern 42 of the coil portion 105 is significantly reduced or prevented effectively.

According to the fifth preferred embodiment provided with the inner dummy pattern 42, as compared to a case in which the width of the conductor pattern or distance between the conductor patterns is determined only by the width of the conductor pattern of the coil portion 105, the flexibility of the shape and arrangement of a conductor pattern is high.

Sixth Preferred Embodiment

A sixth preferred embodiment of the present invention is an example of a coil-incorporated multilayer substrate including an outer dummy pattern and an inner dummy pattern.

Figure 12:
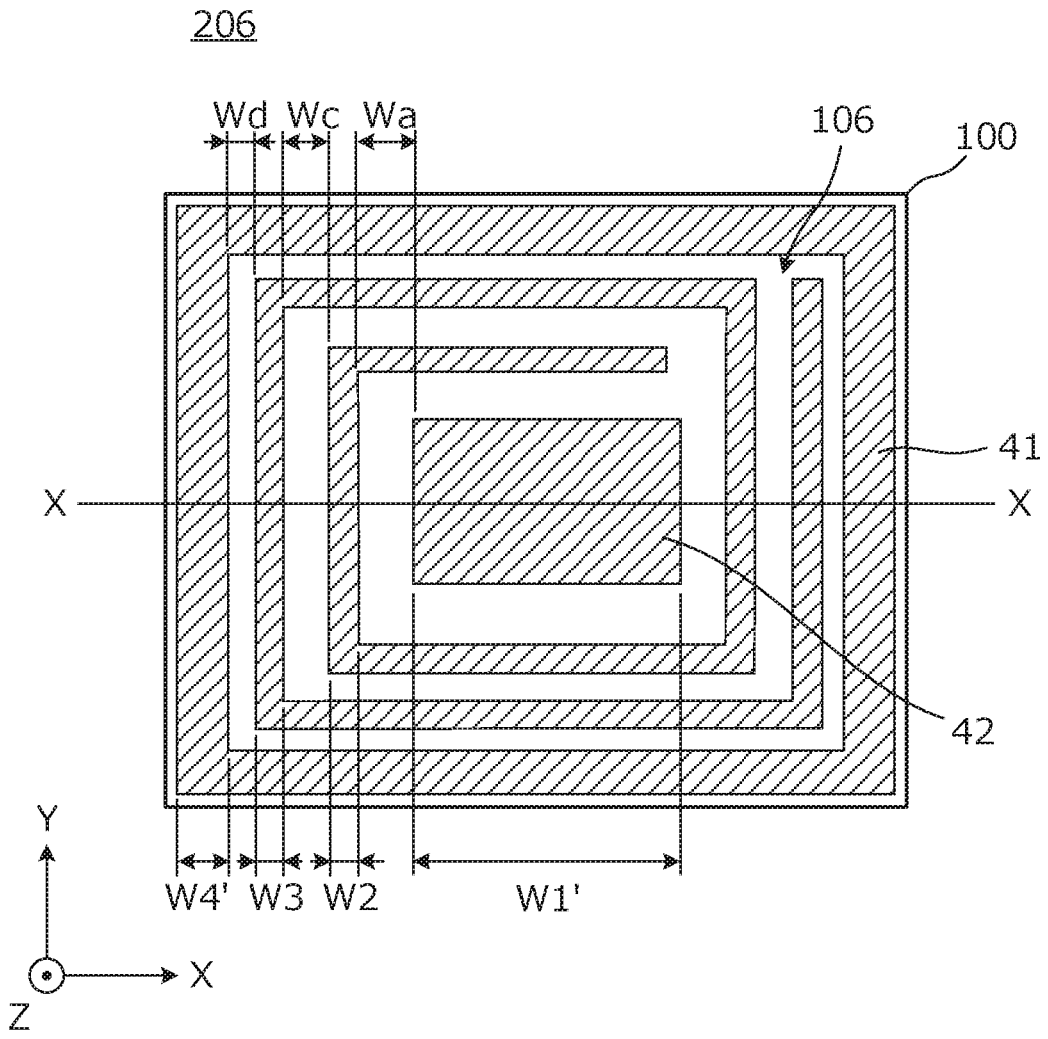
FIG. 12 is a plan view of a coil-incorporated multilayer substrate 206 according to a sixth preferred embodiment of the present invention.

FIG. 12 is a plan view of the coil-incorporated multilayer substrate 206 according to the sixth preferred embodiment of the present invention.

The coil-incorporated multilayer substrate 206 includes a stacked body 100 preferably configured by stacking a plurality of base materials made of thermoplastic resin and each including a conductor pattern.

The stacked body 100 includes a coil portion 106 preferably including rectangular or substantially rectangular spiral shaped conductor patterns; an outer dummy pattern 41 defined by a conductor pattern, on the outer side of the coil portion 106; and an inner dummy pattern 42 defined by a conductor pattern, on the inner side of the coil portion 106.

In the X axis direction along the surface of the stacked body 100 of the coil portion 106 (in the line X-X in FIG. 12), the width of each of the conductor patterns has the following relationships.

The width W4' of the outer dummy pattern 41 is larger than the widths W2 and W3 of the conductor patterns of the coil portion 106 (W2<W4', W3<W4').

The width W1' of the inner dummy pattern 42 is larger than the widths W2 and W3 of the conductor patterns of the coil portion 106 (W2<W1', W3<W1').

The distance Wd between the outer dummy pattern and the conductor pattern of the coil portion adjacent to the outer dummy pattern is smaller than or equal to the distance Wc between the conductor patterns of the coil portion (Wd≤Wc).

The distance Wa between the inner dummy pattern and the conductor pattern of the coil portion adjacent to the inner dummy pattern is smaller than or equal to the width W1' of the inner dummy pattern (Wa≤W1').

Moreover, the width of each of the conductor patterns also has the following relationships.

The distance Wd between the outer dummy pattern 41 and the conductor pattern of the coil portion 106 adjacent to the outer dummy pattern 41 is smaller than or equal to the width W4' of the outer dummy pattern 41 (Wd≤W4').

Since the width of each conductor pattern has the relationships described above, the same or similar operational effect as the operational effect of the third preferred embodiment and the fifth preferred embodiment significantly reduces or prevents the deformation of the conductor pattern caused by resin flow. In particular, in the sixth preferred embodiment, since the distance Wd between the outer dummy pattern 41 and the conductor pattern of the coil portion 106 adjacent to the outer dummy pattern 41 is smaller than or equal to the width W4' of the outer dummy pattern 41, the effect of significantly reducing or preventing the resin from flowing by the outer dummy pattern 41 is increased. Therefore, the deformation of a portion adjacent to the outer dummy pattern 41 of the coil portion 106 is significantly reduced or prevented effectively.

Seventh Preferred Embodiment

A seventh preferred embodiment of the present invention is an example of a coil-incorporated multilayer substrate including an outer dummy pattern and an inner dummy pattern.

Figure 13:
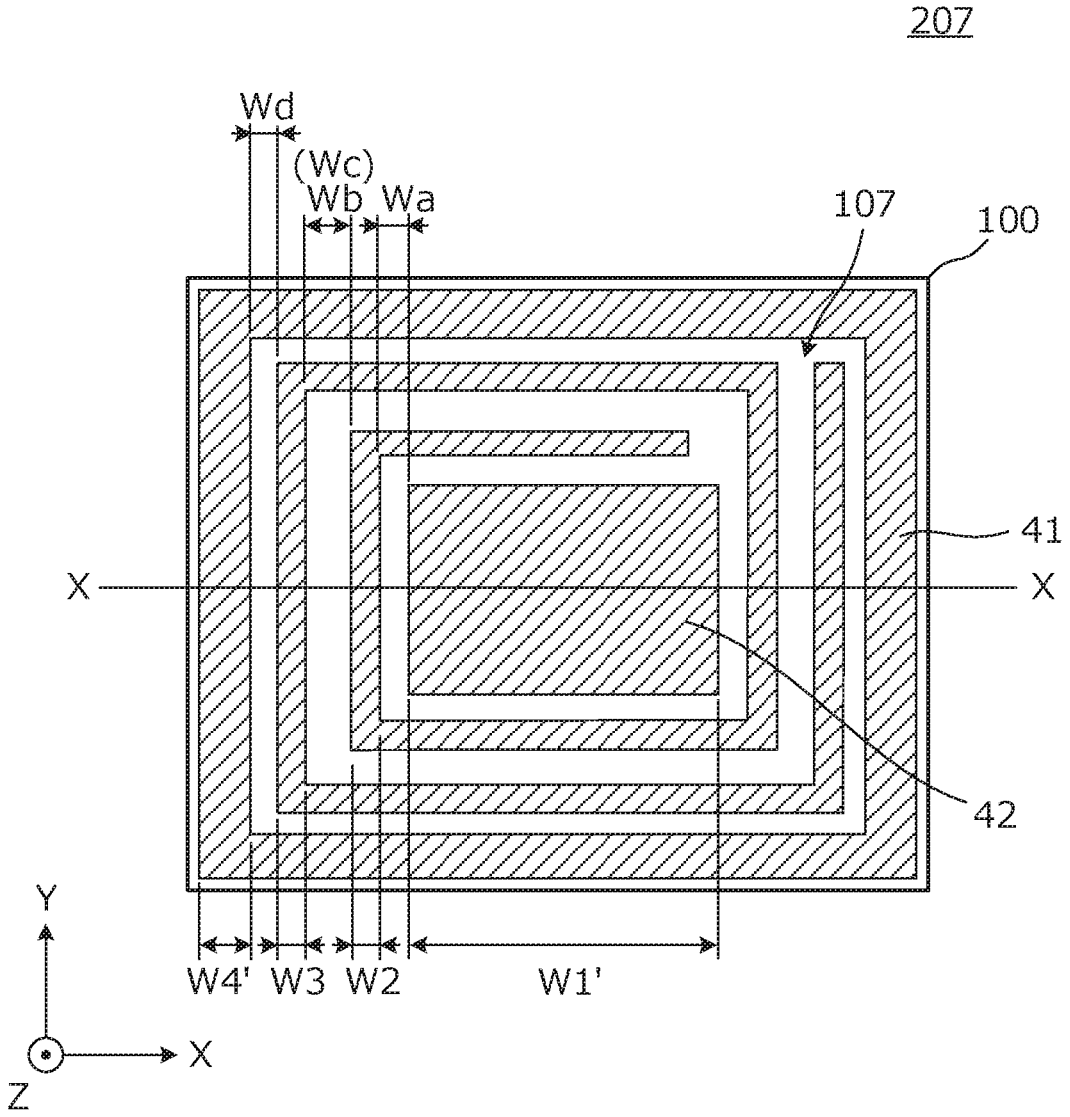
FIG. 13 is a plan view of a coil-incorporated multilayer substrate 207 according to a seventh preferred embodiment of the present invention.

FIG. 13 is a plan view of the coil-incorporated multilayer substrate 207 according to the seventh preferred embodiment of the present invention.

The coil-incorporated multilayer substrate 207 includes a stacked body 100 preferably configured by stacking a plurality of base materials made of thermoplastic resin and each including a conductor pattern.

The stacked body 100 includes a coil portion 107 preferably including rectangular or substantially rectangular spiral shaped conductor patterns; an outer dummy pattern 41 defined by a conductor pattern, on the outer side of the coil portion 107; and an inner dummy pattern 42 defined by a conductor pattern, on the inner side of the coil portion 107.

In the X axis direction along the surface of the stacked body 100 of the coil portion 107 (in the line X-X in FIG. 13), the width of each of the conductor patterns has the following relationships.

The width W4' of the outer dummy pattern 41 is larger than the widths W2 and W3 of the conductor patterns of the coil portion 107 (W2<W4', W3<W4').

The width W1' of the inner dummy pattern 42 is larger than the widths W2 and W3 of the conductor patterns of the coil portion 107 (W2<W1', W3<W1').

The distance Wd between the outer dummy pattern 41 and the conductor pattern of the coil portion adjacent to the outer dummy pattern 41 is smaller than or equal to the distance Wc between the conductor patterns of the coil portion (Wd≤Wc). It is to be noted that the distance Wb and the distance Wc are a distance at the same position in the seventh preferred embodiment.

The distance Wa between the inner dummy pattern 42 and the conductor pattern of the coil portion 107 adjacent to the inner dummy pattern 42 is smaller than or equal to the distance Wb between the conductor patterns of the coil portion 107 (Wa≤Wb).

Since the width of each conductor pattern has the relationships described above, the same or similar operational effect as the operational effect of the third preferred embodiment significantly reduces or prevents the deformation of the conductor pattern caused by resin flow. In particular, in the seventh preferred embodiment, since the distance Wa between the inner dummy pattern 42 and the conductor pattern of the coil portion 107 adjacent to the inner dummy pattern 42 is smaller than or equal to the distance Wb between the conductor patterns of the coil portion 107 (Wa≤Wb), the effect of significantly reducing or preventing the resin from flowing by the inner dummy pattern 42 is increased. Therefore, the deformation of a portion adjacent to the inner dummy pattern 42 of the coil portion 107 is significantly reduced or prevented effectively.

Eighth Preferred Embodiment

An eighth preferred embodiment of the present invention is an example of a coil-incorporated multilayer substrate with an outer dummy pattern and an inner dummy pattern.

Figure 14:
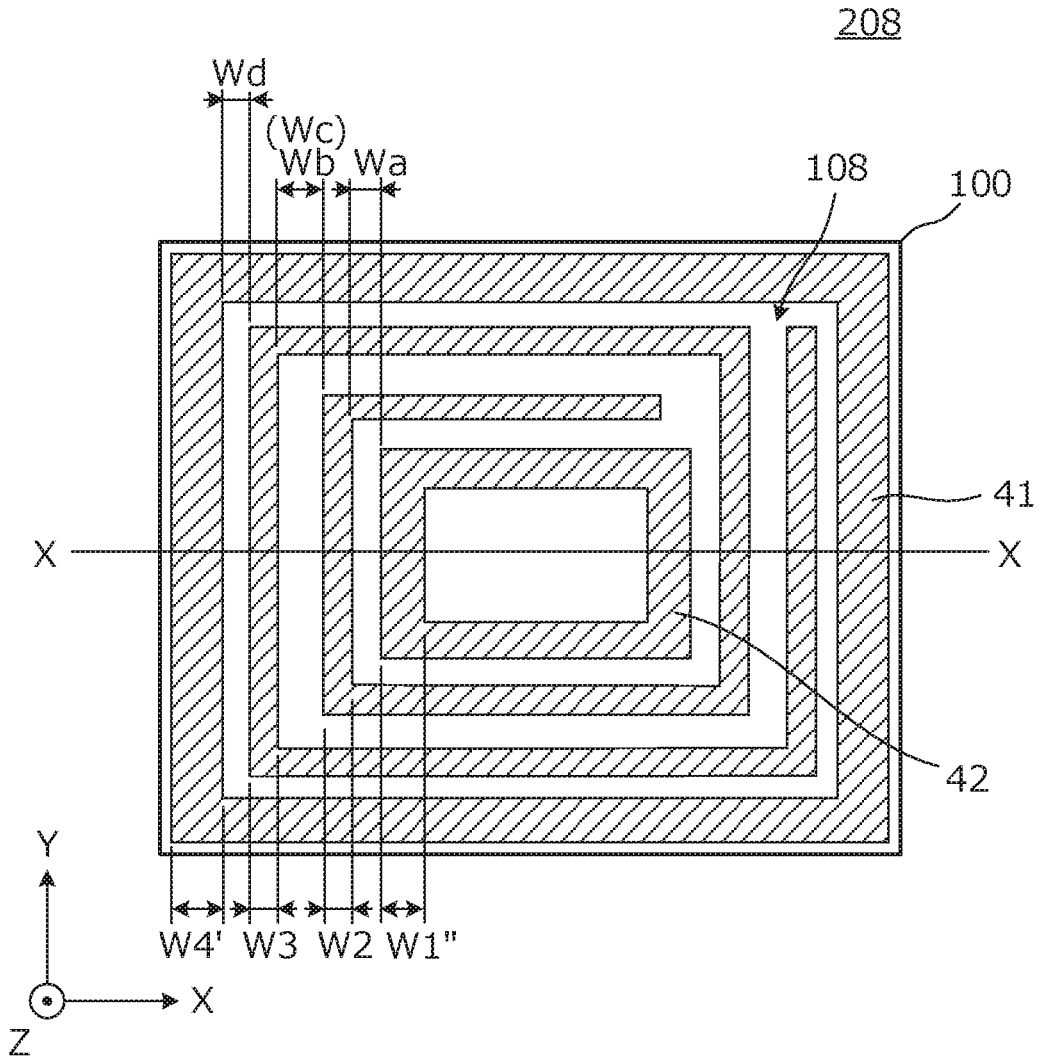
FIG. 14 is a plan view of a coil-incorporated multilayer substrate 208 according to an eighth preferred embodiment of the present invention.

FIG. 14 is a plan view of the coil-incorporated multilayer substrate 208 according to the eighth preferred embodiment of the present invention. The coil-incorporated multilayer substrate 208 is different in the shape of the inner dummy pattern 42 from the coil-incorporated multilayer substrate 207 illustrated in FIG. 13 in the seventh preferred embodiment. In the eighth preferred embodiment, the inner dummy pattern 42 preferably has a rectangular or substantially rectangular ring shape. Thus, even though the inner dummy pattern 42 is not expanded in a planar shape, the line width W1" is relatively large. The width of each of the conductor patterns has the following relationships.

The width W4' of the outer dummy pattern 41 is larger than the widths W2 and W3 of the conductor patterns of the coil portion 108 (W2<W4', W3<W4').

The width W1" of the inner dummy pattern 42 is larger than the widths W2 and W3 of the conductor patterns of the coil portion 108 (W2<W1", W3<W1").

The distance Wd between the outer dummy pattern 41 and the conductor pattern of the coil portion adjacent to the outer dummy pattern 41 is smaller than or equal to the distance Wc between the conductor patterns of the coil portion (Wd≤Wc). It is to be noted that the distance Wb and the distance Wc are a distance at the same position in the eighth preferred embodiment.

The distance Wa between the inner dummy pattern 42 and the conductor pattern of the coil portion 108 adjacent to the inner dummy pattern 42 is smaller than or equal to the distance Wb between the conductor patterns of the coil portion 108 (Wa≤Wb).

Since the width of each conductor pattern has the relationships described above, the deformation of the conductor pattern caused by resin flow is significantly reduced or prevented. In particular, in the eighth preferred embodiment, since the inner side of the inner dummy pattern is open, when the coil-incorporated multilayer substrate is used in a high-frequency band, the magnetic flux that passes through the coil opening of the coil portion 108 is unlikely to be blocked by the inner dummy pattern 42. Therefore, a decrease in inductance is significantly reduced or prevented.

Finally, the foregoing preferred embodiments of the present invention are illustrative in all points and should not be construed to limit the present invention. It is to be understood that variations and modifications will be apparent to those skilled in the art without departing from the scope and spirit of the present invention. For example, configurations illustrated in different preferred embodiments are able to be partially replaced and combined with each other. The scope of the present invention is defined not by the foregoing preferred embodiment but by the following claims. Further, the scope of the present invention is intended to include all modifications within the scopes of the claims and within the meanings and scopes of equivalents.

For example, the coil-incorporated multilayer substrate may include other components in the multilayer substrate. For example, a component, such as a ground conductor and a capacitor conductor, may preferably be included.

In addition, the coil-incorporated multilayer substrate may include an electronic component that is mounted on the surface of the multilayer substrate or may include a built-in electronic component.

Moreover, as long as the requirements described in various preferred embodiments of the present invention are satisfied, the number of turns of the conductor patterns that define a coil has no limit.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A coil-incorporated multilayer substrate comprising:

a conductor pattern made of metal foil;

a base material made of thermoplastic resin and including the conductor pattern; and a coil configured by a plurality of conductor patterns by stacking a plurality of base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is provided, an outer dummy pattern defined by a conductor pattern on an outer side of the coil portion, and an inner dummy pattern defined by a conductor pattern on an inner side of the coil portion are provided;

in at least two perpendicular or substantially perpendicular axial directions along a surface of the at least one of the plurality of base materials, of the plurality of conductor patterns that define the coil portion:

a width of the outer dummy pattern is larger than a width of the conductor patterns of the coil portion;

a width of the inner dummy pattern is larger than the width of the conductor patterns of the coil portion;

a distance between the outer dummy pattern and the conductor pattern of the coil portion adjacent to the outer dummy pattern is smaller than or equal to a distance between the conductor patterns of the coil portion; and a distance between the inner dummy pattern and the conductor pattern of the coil portion adjacent to the inner dummy pattern is smaller than or equal to the width of the inner dummy pattern;

at least one of the outer dummy pattern and the inner dummy pattern is connected to an interlayer connection conductor; and the outer dummy pattern, the inner dummy pattern, and the interlayer connection conductor are not electrically connected to ground.

2. The coil-incorporated multilayer substrate according to claim 1, wherein a distance between the outer dummy pattern and the conductor pattern of the coil portion adjacent to the outer dummy pattern is smaller than or equal to the width of the outer dummy pattern.

3. A coil-incorporated multilayer substrate comprising:

a conductor pattern made of metal foil;

a base material made of thermoplastic resin and including the conductor pattern; and a coil configured by a plurality of conductor patterns by stacking a plurality of base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is provided, an innermost conductor pattern and an outer dummy pattern defined by a conductor pattern on an outer side of the coil portion are provided;

in at least two perpendicular or substantially perpendicular axial directions along a surface of the at least one of the plurality of base materials, of the plurality of conductor patterns that define the coil portion:

a width of the innermost conductor pattern is larger than a width of the conductor patterns of the coil portion other than the innermost conductor pattern;

the width of the innermost conductor pattern is larger than or equal to a distance between the innermost conductor pattern and the conductor pattern adjacent to the innermost conductor pattern;

a width of the outer dummy pattern is larger than the width of the conductor patterns of the coil portion between the innermost conductor pattern and the outer dummy pattern; and without restriction to a distance between the innermost conductor pattern and the conductor pattern adjacent to the innermost conductor pattern, a distance between the outer dummy pattern and the conductor pattern of the coil portion adjacent to the outer dummy pattern is smaller than or equal to a distance between the conductor patterns of the coil portion;

the outer dummy pattern is connected to an interlayer connection conductor; and the outer dummy pattern and the interlayer connection conductor are not electrically connected to ground.

4. The coil-incorporated multilayer substrate according to claim 3, wherein the innermost conductor pattern is connected to another interlayer connection conductor.

5. A coil-incorporated multilayer substrate comprising:

a conductor pattern made of metal foil;

a base material made of thermoplastic resin and including the conductor pattern; and a coil configured by a plurality of conductor patterns by stacking a plurality of base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is provided, an outermost conductor pattern and an inner dummy pattern defined by a conductor pattern on an inner side of the coil portion are provided;

in at least two perpendicular or substantially perpendicular axial directions along a surface of the at least one of the plurality of base materials, of the plurality of conductor patterns that define the coil portion:

a width of the outermost conductor pattern is larger than a width of the conductor patterns of the coil portion other than the outermost conductor pattern;

a width of the inner dummy pattern is larger than or equal to the width of the conductor patterns of the coil portion between the outermost conductor pattern and the inner dummy pattern; and a distance between the inner dummy pattern and the conductor pattern of the coil portion adjacent to the inner dummy pattern is smaller than or equal to the width of the inner dummy pattern;

the inner dummy pattern is connected to an interlayer connection conductor; and the inner dummy pattern and the interlayer connection conductor are not electrically connected to ground.

6. The coil-incorporated multilayer substrate according to claim 5, wherein the outermost conductor pattern is connected to another interlayer connection conductor.

7. A coil-incorporated multilayer substrate comprising:

a conductor pattern made of metal foil;

a base material made of thermoplastic resin and including the conductor pattern; and a coil configured by a plurality of conductor patterns by stacking a plurality of base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is provided, an outer dummy pattern defined by a conductor pattern on an outer side of the coil portion, and an inner dummy pattern defined by a conductor pattern on an inner side of the coil portion are provided;

in at least two perpendicular or substantially perpendicular axial directions along a surface of the at least one of the plurality of base materials, of the plurality of conductor patterns that define the coil portion:

a width of the outer dummy pattern is larger than a width of the conductor patterns of the coil portion;

a width of the inner dummy pattern is larger than the width of the conductor patterns of the coil portion;

a distance between the outer dummy pattern and the conductor pattern of the coil portion adjacent to the outer dummy pattern is smaller than or equal to a distance between the conductor patterns of the coil portion; and a distance between the inner dummy pattern and the conductor pattern of the coil portion adjacent to the inner dummy pattern is smaller than or equal to a distance between the conductor patterns of the coil portion;

at least one of the outer dummy pattern and the inner dummy pattern is connected to an interlayer connection conductor; and the outer dummy pattern, the inner dummy pattern, and the interlayer connection conductor are not electrically connected to ground.

8. A coil-incorporated multilayer substrate comprising:

a conductor pattern made of metal foil;

a base material made of thermoplastic resin and including the conductor pattern; and a coil configured by a plurality of conductor patterns by stacking a plurality of base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is provided, an outermost conductor pattern and an inner dummy pattern defined by a conductor pattern on an inner side of the coil portion are provided;

in at least two perpendicular or substantially perpendicular axial directions along a surface of the at least one of the plurality of base materials, of the plurality of conductor patterns that define the coil portion:

a width of the outermost conductor pattern is larger than a width of the conductor patterns of the coil portion other than the outermost conductor pattern;

a width of the inner dummy pattern is larger than the width of the conductor patterns of the coil portion between the outermost conductor pattern and the inner dummy pattern; and a distance between the inner dummy pattern and the conductor pattern of the coil portion adjacent to the inner dummy pattern is smaller than or equal to a distance between the conductor patterns of the coil portion;

the inner dummy pattern is connected to an interlayer connection conductor; and the inner dummy pattern and the interlayer connection conductor are not electrically connected to ground.

9. A method for manufacturing a coil-incorporated multilayer substrate including:

a conductor pattern made of metal foil;

a base material made of thermoplastic resin and including the conductor pattern; and a coil configured by a plurality of conductor patterns by stacking a plurality of base materials, the method comprising:

a first step of preparing the plurality of base materials;

a second step of forming the conductor pattern on a predetermined base material among the plurality of base materials;

a third step of stacking the plurality of base materials to form a stacked body; and a fourth step of thermally pressing the stacked body and softening and bonding the base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is formed, an outer dummy pattern defined by a conductor pattern on an outer side of the coil portion, and an inner dummy pattern defined by a conductor pattern on an inner side of the coil portion are formed;

in at least two perpendicular or substantially perpendicular axial directions along a surface of the at least one of the plurality of base materials, of the plurality of conductor patterns that define the coil portion:

a width of the outer dummy pattern is larger than a width of the conductor patterns of the coil portion;

a width of the inner dummy pattern is larger than the width of the conductor patterns of the coil portion;

a distance between the outer dummy pattern and the conductor pattern of the coil portion adjacent to the outer dummy pattern is smaller than or equal to a distance between the conductor patterns of the coil portion; and a distance between the inner dummy pattern and the conductor pattern of the coil portion adjacent to the inner dummy pattern is smaller than or equal to the width of the inner dummy pattern;

at least one of the outer dummy pattern and the inner dummy pattern is connected to an interlayer connection conductor; and the outer dummy pattern, the inner dummy pattern, and the interlayer connection conductor are not electrically connected to ground.

10. A method for manufacturing a coil-incorporated multilayer substrate including:

a conductor pattern made of metal foil;

a base material made of thermoplastic resin and including the conductor pattern; and a coil configured by a plurality of conductor patterns by stacking a plurality of base materials, the method comprising:

a first step of preparing the plurality of base materials;

a second step of forming the conductor pattern on a predetermined base material among the plurality of base materials;

a third step of stacking the plurality of base materials to form a stacked body; and a fourth step of thermally pressing the stacked body and softening and bonding the base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is formed, an innermost conductor pattern and an outer dummy pattern defined by a conductor pattern on an outer side of the coil portion are formed;

in at least two perpendicular or substantially perpendicular axial directions along a surface of the at least one of the plurality of base materials, of the plurality of conductor patterns that define the coil portion:

a width of the innermost conductor pattern is larger than a width of the conductor patterns of the coil portion other than the innermost conductor pattern;

the width of the innermost conductor pattern is larger than or equal to a distance between the innermost conductor pattern and the conductor pattern adjacent to the innermost conductor pattern;

a width of the outer dummy pattern is larger than a width of the conductor patterns of the coil portion between the innermost conductor pattern and the outer dummy pattern; and without restriction to a distance between the innermost conductor pattern and the conductor pattern adjacent to the innermost conductor pattern, a distance between the outer dummy pattern and the conductor pattern of the coil portion adjacent to the outer dummy pattern is smaller than or equal to a distance between the conductor patterns of the coil portion;

the outer dummy pattern is connected to an interlayer connection conductor; and the outer dummy pattern and the interlayer connection conductor are not electrically connected to ground.

11. A method for manufacturing a coil-incorporated multilayer substrate including:

a conductor pattern made of metal foil;

a base material made of thermoplastic resin and including the conductor pattern; and a coil configured by a plurality of conductor patterns by stacking a plurality of base materials, the method comprising:

a first step of preparing the plurality of base materials;

a second step of forming the conductor pattern on a predetermined base material among the plurality of base materials;

a third step of stacking the plurality of base materials to form a stacked body; and a fourth step of thermally pressing the stacked body and softening and bonding the base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is formed, an outermost conductor pattern and an inner dummy pattern defined by a conductor pattern on an inner side of the coil portion are formed;

in at least two perpendicular or substantially perpendicular axial directions along a surface of the at least one of the plurality of base materials, of the plurality of conductor patterns that define the coil portion:

a width of the outermost conductor pattern is larger than a width of the conductor patterns of the coil portion other than the outermost conductor pattern;

a width of the inner dummy pattern is larger than or equal to a width of the conductor patterns of the coil portion between the outermost conductor pattern and the inner dummy pattern; and a distance between the inner dummy pattern and the conductor pattern of the coil portion adjacent to the inner dummy pattern is smaller than or equal to the width of the inner dummy pattern;

the inner dummy pattern is connected to an interlayer connection conductor; and the inner dummy pattern and the interlayer connection conductor are not electrically connected to ground.

12. A method for manufacturing a coil-incorporated multilayer substrate including:

a conductor pattern made of metal foil;

a base material made of thermoplastic resin and including the conductor pattern; and a coil configured by a plurality of conductor patterns by stacking a plurality of base materials, the method comprising:

a first step of preparing the plurality of base materials;

a second step of forming the conductor pattern on a predetermined base material among the plurality of base materials;

a third step of stacking the plurality of base materials to form a stacked body; and a fourth step of thermally pressing the stacked body and softening and bonding the base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is formed, an outer dummy pattern defined by a conductor pattern on an outer side of the coil portion, and an inner dummy pattern defined by a conductor pattern on an inner side of the coil portion are formed;

in at least two perpendicular or substantially perpendicular axial directions along a surface of the at least one of the plurality of base materials, of the plurality of conductor patterns that define the coil portion:

a width of the outer dummy pattern is larger than a width of the conductor patterns of the coil portion;

a width of the inner dummy pattern is larger than the width of the conductor patterns of the coil portion;

a distance between the inner dummy pattern and the conductor pattern of the coil portion adjacent to the inner dummy pattern is smaller than or equal to a distance between the conductor patterns of the coil portion; and a distance between the outer dummy pattern and the conductor pattern of the coil portion adjacent to the outer dummy pattern is smaller than or equal to a distance between the conductor patterns of the coil portion;

at least one of the outer dummy pattern and the inner dummy pattern is connected to an interlayer connection conductor; and the outer dummy pattern, the inner dummy pattern, and the interlayer connection conductor are not electrically connected to ground.

13. A method for manufacturing a coil-incorporated multilayer substrate including:

a conductor pattern made of metal foil;

a base material made of thermoplastic resin and including the conductor pattern; and a coil configured by a plurality of conductor patterns by stacking a plurality of base materials, the method comprising:

a first step of preparing the plurality of base materials;

a second step of forming the conductor pattern on a predetermined base material among the plurality of base materials;

a third step of stacking the plurality of base materials to form a stacked body; and a fourth step of thermally pressing the stacked body and softening and bonding the base materials; wherein the plurality of base materials that are each made of the thermoplastic resin and that each include the conductor pattern are joined directly to one another;

the coil includes a coil axis in a stacking direction in which the plurality of base materials are stacked;

the coil includes a coil portion defined by the plurality of conductor patterns that are shaped so as to be wound around the coil axis a plurality of times;

at least one of the plurality of base materials includes the coil portion;

on the at least one of the plurality of base materials on which the coil portion is formed, an outermost conductor pattern and an inner dummy pattern defined by a conductor pattern on an inner side of the coil portion are formed;

in at least two perpendicular or substantially perpendicular axial directions along a surface of the at least one of the plurality of base materials, of the plurality of conductor patterns that define the coil portion:

a width of the outermost conductor pattern is larger than a width of the conductor patterns of the coil portion other than the outermost conductor pattern;

a width of the inner dummy pattern is larger than the width of the conductor patterns of the coil portion between the outermost conductor pattern and the inner dummy pattern; and a distance between the inner dummy pattern and the conductor pattern of the coil portion adjacent to the inner dummy pattern is smaller than or equal to a distance between the conductor patterns of the coil portion;

the inner dummy pattern is connected to an interlayer connection conductor; and the inner dummy pattern and the interlayer connection conductor are not electrically connected to ground.

* * * * *